US007311788B2

(12) United States Patent
Nishizawa et al.

(10) Patent No.: US 7,311,788 B2
(45) **Date of Patent: *Dec. 25, 2007**

(54) R-T-B SYSTEM RARE EARTH PERMANENT MAGNET

(75) Inventors: Gouichi Nishizawa, Tokyo (JP); Chikara Ishizaka, Tokyo (JP); Tetsuya Hidaka, Tokyo (JP); Akira Fukuno, Tokyo (JP); Yoshinori Fujikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 346 days.

This patent is subject to a terminal disclaimer.

(21) Appl. No.: 10/675,230

(22) Filed: Sep. 29, 2003

(65) Prior Publication Data

US 2004/0177899 A1 Sep. 16, 2004

(30) Foreign Application Priority Data

Sep. 30, 2002 (JP) ..... 2002-287033
Mar. 28, 2003 (JP) ..... 2003-092891

(51) Int. Cl.
*H01F 1/057* (2006.01)

(52) U.S. Cl. ..... 148/302; 75/244

(58) Field of Classification Search ..... None
See application file for complete search history.

(56) References Cited

U.S. PATENT DOCUMENTS 6,468,365 B1 * 10/2002 Uchida et al. ..... 148/302
6,811,620 B2 * 11/2004 Ishizaka et al. ..... 148/302
2002/0003006 A1 * 1/2002 Nishimoto et al. ..... 148/102
2002/0007875 A1 * 1/2002 Yamamoto et al. ..... 148/302
2002/0112785 A1 * 8/2002 Sekine et al. ..... 148/302
2004/0118484 A1 * 6/2004 Nishizawa et al. ..... 148/302
2004/0187969 A1 * 9/2004 Ishizaka et al. ..... 148/302

(Continued)

FOREIGN PATENT DOCUMENTS

EP 0 302 395 2/1989

(Continued)

OTHER PUBLICATIONS

Kim, et al., "Microstructure of ZR Containing NDFEB", IEEE Transactions on Magnetics, IEEE Inc., New York, US, vol. 33, No. 5, Part 2, Sep. 1997, pp. 3823-3825.

(Continued)

*Primary Examiner*—John P. Sheehan
(74) *Attorney, Agent, or Firm*—Hogan & Hartson LLP

(57) ABSTRACT

A sintered body with a composition consisting of 25% to 35% by weight of R (wherein R represents one or more rare earth elements, provided that the rare earth elements include Y), 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe. This sintered body has a coefficient of variation (CV value) showing the dispersion degree of Zr of 130 or less. In addition, this sintered body has a grain boundary phase comprising a region that is rich both in at least one element selected from a group consisting of Cu, Co and R, and in Zr. This sintered body enables to inhibit the grain growth, while keeping the decrease of magnetic properties to a minimum, and to improve the suitable sintering temperature range.

6 Claims, 33 Drawing Sheets

U.S. PATENT DOCUMENTS

2004/0187970 A1* 9/2004 Ishizaka et al. ..... 148/302

FOREIGN PATENT DOCUMENTS

| | | |
|---|---|---|
| EP | 0 344 542 | 12/1989 |
| EP | 1 164 599 | 12/2001 |
| JP | 62-074054 | 9/1987 |
| JP | 01-219143 | 9/1989 |
| JP | 07-176414 | 7/1995 |
| JP | 09-223617 | 8/1997 |
| JP | 10-041113 | 2/1998 |
| JP | 10-064712 | 3/1998 |
| JP | 10-259459 | 12/1998 |
| JP | 2000-234151 | 8/2000 |
| JP | 2002-075717 | 3/2002 |
| JP | 2002-164239 | 6/2002 |

OTHER PUBLICATIONS

Pollard, et al., "Effect of ZR Additions On The Microstructural and Magnetic Properties of NDFEB Based Magnets", IEEE Transactions on Magnetics, IEEE Inc., New York, U.S., vol. 24, No. 2, Mar. 1988, pp. 1626-1628.

Besenicar, S., "The Influence of ZR02 Addition on the Microstructure and the Magnetic Properties of ND-DY-FE-B Magnets", Journal of Magnetism and Magnetic Materials, Elsevier Science Publishers, Amsterdam, NL, vol. 104-107, No. Part 2, Feb. 1992, pp. 1175-1178.

Bensenicar, et al., "The Influence of ZR02 Addition on Phase Composition In The ND-DY-FE-B System and Improved Corrosion Resistance of the Magnets", IEEE Inc., New York, US, vol. 30, No. 2, Part 2, Mar. 1994, pp. 693-695.

* cited by examiner

FIG. 11

| | | |
|---|---|---|
| ALLOY a1 | LOW R ALLOY | 23.6Nd−6Pr−0.3Dy−1.1B−0.05Cu−0.2Al−bal.Fe(wt. %) |
| ALLOY a2 | LOW R ALLOY CONTAINING Zr | 23.6Nd−6Pr−0.3Dy−1.1B−0.05Cu−0.2Al−0.32Zr−bal.Fe(wt. %) |
| ALLOY a3 | LOW R ALLOY CONTAINING Zr | 15.7Nd−6Pr−8.1Dy−1.1B−0.05Cu−0.2Al−0.15Zr−bal.Fe(wt. %) |
| ALLOY a4 | LOW R ALLOY CONTAINING Zr | 23.9Nd−6Pr−1.1B−0.05Cu−0.2Al−0.15Zr−bal.Fe(wt. %) |
| ALLOY a5 | LOW R ALLOY CONTAINING Zr (WITH HIGH Al) | 23 .6Nd−6Pr−0.3Dy−1.1B−0.05Cu−0.42Al−0.12Zr−bal.Fe(wt. %) |
| ALLOY a6 | LOW R ALLOY CONTAINING Zr (WITHOUT Al) | 23 .6Nd−6Pr−0.3Dy−1.1B−0.05Cu−0.12Zr−bal.Fe(wt. %) |
| ALLOY a7 | LOW R ALLOY CONTAINING Zr | 27.9Nd−0.1Dy−1.1B−0.03Cu−0.05Al−0.08Zr−bal.Fe(wt. %) |
| ALLOY a8 | LOW R ALLOY CONTAINING Zr | 23.7Nd−6Pr−0.2Dy−1.6B−0.3Cu−0.25Al−0.3Zr−bal.Fe(wt. %) |
| ALLOY b1 | HIGH R ALLOY (WITHOUT B) | 40.6Nd−0.05Cu−5Co−0.2Al−bal.Fe(wt. %) |
| ALLOY b2 | HIGH R ALLOY CONTAINING Zr (WITH B) | 40.6Nd−0.5B−0.05Cu−5Co−0.2Al−3.1Zr−bal.Fe(wt. %) |
| ALLOY b3 | HIGH R ALLOY (WITHOUT B AND Al) | 40.6Nd−0.05Cu−5Co−bal.Fe(wt. %) |
| ALLOY b4 | HIGH R ALLOY (WITHOUT B) | 35.1Nd−0.03Cu−2Co−0.05Al−bal.Fe(wt. %) |
| ALLOY b5 | HIGH R ALLOY (WITHOUT B) | 40.6Nd−0.3Cu−20Co−0.25Al−bal.Fe(wt. %) |

FIG. 12

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ | CV VALUE |
|---|---|---|---|---|---|---|---|---|---|---|
| 1 | Fe-24.9Nd-5.4Pr-0.4Dy-1B-0.05Cu-0.2Al-0.5Co | 1210 | ALLOY a1 | ALLOY b1 | 1070℃ | 13.91 | 12.59 | 38 | 15.17 | - |
| 2 | Fe-24.9Nd-5.4Pr-0.4Dy-1B-0.05Cu-0.2Al-0.5Co-0.01Zr | 1290 | ALLOY a1 + ALLOY a2 | ALLOY b1 | | 13.94 | 13.28 | 57 | 15.27 | 68 |
| 3 | Fe-24.9Nd-5.4Pr-0.4Dy-1B-0.05Cu-0.2Al-0.5Co-0.02Zr | 1160 | | | | 13.95 | 13.29 | 79 | 15.28 | 70 |
| 4 | Fe-24.9Nd-5.4Pr-0.4Dy-1B-0.05Cu-0.2Al-0.5Co-0.03Zr | 1360 | | | | 13.96 | 13.34 | 96 | 15.29 | 66 |
| 5 | Fe-24.9Nd-5.4Pr-0.4Dy-1B-0.05Cu-0.2Al-0.5Co-0.05Zr | 1090 | | | | 13.96 | 13.33 | 96 | 15.29 | 72 |
| 6 | Fe-24.9Nd-5.4Pr-0.4Dy-1B-0.05Cu-0.2Al-0.5Co-0.10Zr | 1190 | | | | 13.97 | 13.31 | 96 | 15.30 | 78 |
| 7 | Fe-24.9Nd-5.4Pr-0.4Dy-1B-0.05Cu-0.2Al-0.5Co-0.20Zr | 1110 | | | | 13.99 | 13.64 | 97 | 15.35 | 101 |
| 8 | Fe-24.9Nd-5.4Pr-0.4Dy-1B-0.05Cu-0.2Al-0.5Co-0.25Zr | 1320 | | | | 13.94 | 13.75 | 97 | 15.32 | 99 |
| 9 | Fe-24.9Nd-5.4Pr-0.4Dy-1B-0.05Cu-0.2Al-0.5Co-0.30Zr | 1240 | | | | 13.85 | 13.85 | 98 | 15.24 | 110 |
| 10 | Fe-24.8Nd-5.5Pr-0.3Dy-1B-0.05Cu-0.2Al-0.5Co-0.05Zr | 1350 | ALLOY a1 | ALLOY b1 + ALLOY b2 | | 13.89 | 13.32 | 63 | 15.22 | 159 |
| 11 | Fe-24.8Nd-5.5Pr-0.3Dy-1B-0.05Cu-0.2Al-0.5Co-0.10Zr | 1400 | | | | 13.84 | 13.43 | 95 | 15.18 | 214 |
| 12 | Fe-24.8Nd-5.5Pr-0.3Dy-1B-0.05Cu-0.2Al-0.5Co-0.20Zr | 1170 | | | | 13.78 | 13.56 | 97 | 15.14 | 257 |
| 13 | Fe-24.8Nd-5.5Pr-0.3Dy-1B-0.05Cu-0.2Al-0.5Co-0.25Zr | 1220 | | | | 13.71 | 13.71 | 98 | 15.08 | 281 |
| 14 | Fe-24.8Nd-5.5Pr-0.3Dy-1B-0.05Cu-0.2Al-0.5Co-0.30Zr | 1310 | | | | 13.62 | 13.88 | 98 | 15.01 | 275 |
| 15 | Fe-24.9Nd-5.4Pr-0.4Dy-1B-0.05Cu-0.2Al-0.5Co | 1888 | ALLOY a1 | ALLOY b1 | | 13.89 | 11.44 | 54 | 15.03 | - |
| 16 | Fe-24.9Nd-5.4Pr-0.4Dy-1B-0.05Cu-0.2Al-0.5Co-0.10Zr | 1820 | ALLOY a1 + ALLOY a2 | ALLOY b1 | | 13.97 | 12.33 | 97 | 15.20 | 81 |
| 17 | Fe-24.9Nd-5.4Pr-0.4Dy-1B-0.05Cu-0.2Al-0.5Co-0.20Zr | 1920 | | | | 13.98 | 12.58 | 97 | 15.24 | 98 |
| 18 | Fe-24.9Nd-5.4Pr-0.4Dy-1B-0.05Cu-0.2Al-0.5Co-0.25Zr | 1870 | | | | 13.93 | 12.81 | 98 | 15.21 | 97 |
| 19 | Fe-24.8Nd-5.5Pr-0.3Dy-1B-0.05Cu-0.2Al-0.5Co-0.10Zr | 1800 | ALLOY a1 | ALLOY b1 + ALLOY b2 | | 13.81 | 12.39 | 96 | 15.05 | 223 |
| 20 | Fe-24.8Nd-5.5Pr-0.3Dy-1B-0.05Cu-0.2Al-0.5Co-0.20Zr | 1960 | | | | 13.75 | 12.55 | 97 | 15.01 | 263 |

FIG. 13

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ |
|---|---|---|---|---|---|---|---|---|---|
| 21 | Fe-24.9Nd-5.4Pr-0.4Dy-1B-0.05Cu-0.2Al-0.5Co | 1210 | ALLOY a1 | ALLOY b1 | 1050℃ | 13.94 | 13.24 | 86 | 15.26 |
| 22 | Fe-24.9Nd-5.4Pr-0.4Dy-1B-0.05Cu-0.2Al-0.5Co-0.01Zr | 1260 | ALLOY a1 + ALLOY a2 | ALLOY b1 | | 13.94 | 13.23 | 91 | 15.26 |
| 23 | Fe-24.9Nd-5.4Pr-0.4Dy-1B-0.05Cu-0.2Al-0.5Co-0.02Zr | 1180 | | | | 13.95 | 13.19 | 94 | 15.27 |
| 24 | Fe-24.9Nd-5.4Pr-0.4Dy-1B-0.05Cu-0.2Al-0.5Co-0.03Zr | 1360 | | | | 13.94 | 13.19 | 94 | 15.26 |
| 25 | Fe-24.9Nd-5.4Pr-0.4Dy-1B-0.05Cu-0.2Al-0.5Co-0.05Zr | 1110 | | | | 13.94 | 13.23 | 95 | 15.26 |
| 26 | Fe-24.9Nd-5.4Pr-0.4Dy-1B-0.05Cu-0.2Al-0.5Co-0.10Zr | 1170 | | | | 13.94 | 13.28 | 95 | 15.27 |
| 27 | Fe-24.9Nd-5.4Pr-0.4Dy-1B-0.05Cu-0.2Al-0.5Co-0.20Zr | 1200 | | | | 13.91 | 13.55 | 95 | 15.27 |
| 28 | Fe-25.0Nd-5.4Pr-0.3Dy-1B-0.05Cu-0.2Al-0.5Co-0.05Zr | 1300 | ALLOY a1 | ALLOY b1 + ALLOY b2 | | 13.88 | 12.96 | 96 | 15.18 |
| 29 | Fe-24.8Nd-5.5Pr-0.3Dy-1B-0.05Cu-0.2Al-0.5Co-0.10Zr | 1370 | | | | 13.85 | 12.76 | 97 | 15.13 |
| 30 | Fe-24.8Nd-5.5Pr-0.3Dy-1B-0.05Cu-0.2Al-0.5Co-0.20Zr | 1250 | | | | 13.68 | 12.58 | 98 | 14.94 |
| 31 | Fe-24.9Nd-5.4Pr-0.4Dy-1B-0.05Cu-0.01Al-0.5Co-0.10Zr | 1220 | ALLOY a5 + ALLOY a6 | ALLOY b1 + ALLOY b3 | | 14.15 | 11.20 | 95 | 15.27 |
| 32 | Fe-24.9Nd-5.4Pr-0.4Dy-1B-0.05Cu-0.03Al-0.5Co-0.10Zr | 1310 | | | | 14.14 | 12.49 | 96 | 15.39 |
| 33 | Fe-24.9Nd-5.4Pr-0.4Dy-1B-0.05Cu-0.05Al-0.5Co-0.10Zr | 1140 | | | | 14.13 | 12.60 | 95 | 15.39 |
| 34 | Fe-24.9Nd-5.4Pr-0.4Dy-1B-0.05Cu-0.3Al-0.5Co-0.10Zr | 1180 | | | | 13.87 | 13.27 | 97 | 15.20 |
| 35 | Fe-24.9Nd-5.4Pr-0.4Dy-1B-0.05Cu-0.4Al-0.5Co-0.10Zr | 1230 | | | | 13.61 | 13.00 | 96 | 14.91 |

FIG. 19

| No. | COMPOSITIONS OF SINTERED BODIES (wt. %) | AMOUNT OF OXYGEN (ppm) | SINTERING TEMPERA-TURE | Br (kG) | HcJ (kOe) | Hk/HcJ (%) | Br+0.1 × HcJ | CV VALUE |
|---|---|---|---|---|---|---|---|---|
| 36 | Fe-24.9Nd-5.4Pr-0.4Dy-1B-0.05Cu-0.2Al-0.5Co | 680 | 1010°C | 14.03 | 11.68 | 87 | 15.20 | - |
| 37 | | | 1030°C | 14.05 | 13.92 | 88 | 15.44 | - |
| 38 | | | 1050°C | 14.13 | 12.64 | 29 | 15.39 | - |
| 39 | | | 1060°C | 14.08 | 5.53 | 22 | 14.63 | - |
| 40 | Fe-24.9Nd-5.4Pr-0.4Dy-1B-0.05Cu-0.2Al-0.5Co-0.05Zr | 670 | 1010°C | 14.00 | 12.84 | 90 | 15.29 | - |
| 41 | | | 1030°C | 14.03 | 14.17 | 92 | 15.44 | - |
| 42 | | | 1050°C | 14.09 | 14.37 | 90 | 15.53 | - |
| 43 | | | 1060°C | 14.04 | 14.00 | 53 | 15.44 | - |
| 44 | Fe-24.9Nd-5.4Pr-0.4Dy-1B-0.05Cu-0.2Al-0.5Co-0.08Zr | 870 | 1010°C | 14.06 | 12.76 | 91 | 15.33 | - |
| 45 | | | 1030°C | 14.05 | 14.61 | 90 | 15.51 | - |
| 46 | | | 1040°C | 14.16 | 14.59 | 94 | 15.62 | - |
| 47 | | | 1050°C | 14.14 | 14.61 | 95 | 15.60 | - |
| 48 | | | 1060°C | 14.16 | 14.60 | 95 | 15.62 | - |
| 49 | | | 1070°C | 14.17 | 14.60 | 93 | 15.63 | - |
| 50 | | | 1090°C | 14.18 | 13.51 | 44 | 15.53 | - |
| 51 | Fe-24.9Nd-5.4Pr-0.4Dy-1B-0.05Cu-0.2Al-0.5Co-0.11Zr | 700 | 1010°C | 14.03 | 12.85 | 88 | 15.31 | 65 |
| 52 | | | 1030°C | 14.10 | 14.67 | 92 | 15.57 | 71 |
| 53 | | | 1040°C | 14.13 | 14.66 | 95 | 15.59 | 77 |
| 54 | | | 1050°C | 14.15 | 14.71 | 95 | 15.62 | 75 |
| 55 | | | 1060°C | 14.15 | 14.69 | 97 | 15.62 | 72 |
| 56 | | | 1070°C | 14.09 | 14.61 | 97 | 15.55 | 75 |
| 57 | | | 1090°C | 14.08 | 14.49 | 97 | 15.53 | 81 |
| 58 | | | 1150°C | 14.01 | 0.11 | 14 | 14.02 | 142 |
| 59 | Fe-24.9Nd-5.4Pr-0.4Dy-1B-0.05Cu-0.2Al-0.5Co-0.15Zr | 740 | 1010°C | 14.04 | 12.85 | 86 | 15.32 | 68 |
| 60 | | | 1030°C | 14.13 | 14.72 | 93 | 15.60 | 75 |
| 61 | | | 1040°C | 14.09 | 14.77 | 95 | 15.57 | 72 |
| 62 | | | 1050°C | 14.14 | 14.79 | 95 | 15.62 | 80 |
| 63 | | | 1060°C | 14.14 | 14.72 | 97 | 15.61 | 85 |
| 64 | | | 1070°C | 14.07 | 14.66 | 99 | 15.53 | 88 |
| 65 | | | 1090°C | 14.02 | 14.51 | 99 | 15.47 | 91 |
| 66 | | | 1150°C | 14.00 | 0.50 | 27 | 14.05 | 150 |
| 67 | Fe-24.9Nd-5.4Pr-0.4Dy-1B-0.05Cu-0.2Al-0.5Co-0.18Zr | 810 | 1010°C | 13.98 | 12.81 | 87 | 15.26 | - |
| 68 | | | 1030°C | 14.07 | 14.67 | 93 | 15.54 | - |
| 69 | | | 1040°C | 14.13 | 14.80 | 95 | 15.61 | - |
| 70 | | | 1050°C | 14.05 | 14.72 | 96 | 15.52 | - |
| 71 | | | 1060°C | 14.18 | 14.78 | 97 | 15.65 | - |
| 72 | | | 1070°C | 14.03 | 14.76 | 98 | 15.51 | - |
| 73 | | | 1090°C | 14.08 | 14.63 | 98 | 15.54 | - |
| 74 | | | 1100°C | 14.01 | 14.45 | 98 | 15.46 | - |
| 75 | | | 1150°C | 14.04 | 1.75 | 41 | 14.22 | - |

FIG. 21
(a) No. 37 1030℃ Zr-free
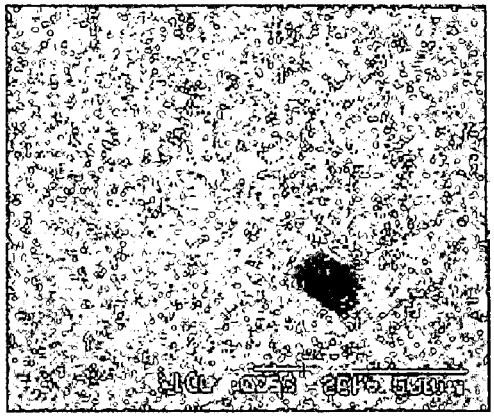
(b) No. 39 1060℃ Zr-free
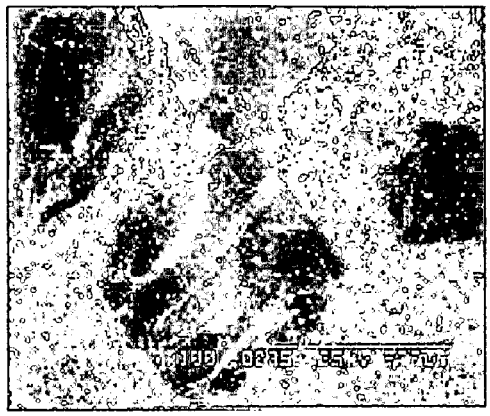
(c) No. 43 1060℃ 0.05%Zr
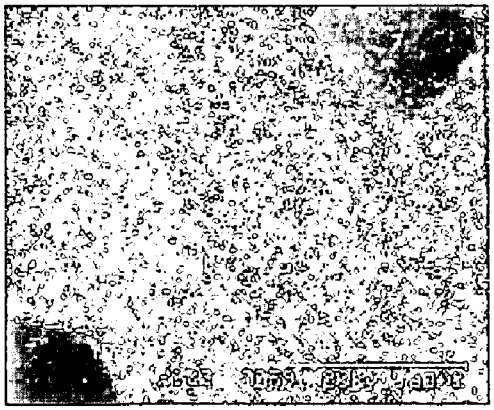
(d) No. 48 1060℃ 0.08Zr
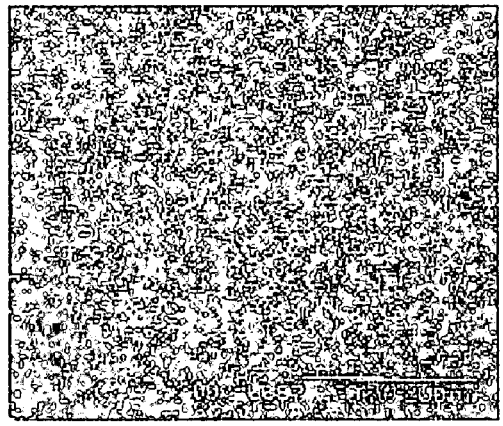

FIG. 27

| No. | COMPOSITIONS OF SINTERED BODIES(wt. %) | LOW R ALLOYS | HIGH R ALLOYS | SINTERING TEMPERA-TURE | Br (kG) | HcJ (kOe) | Hk/HcJ (%) | Br+0.1 × HcJ |
|---|---|---|---|---|---|---|---|---|
| 76 | Fe-25.0Nd-5.3Pr-1B-0.05Cu-0.2Al-0.5Co-0.13Zr | ALLOY a4 | ALLOY b1 | 1060℃ | 14.42 | 12.62 | 98 | 15.68 |
| 77 | Fe-23.2Nd-5.4Pr-2.1Dy-1B-0.05Cu-0.2Al-0.5Co-0.13Zr | ALLOY a1 + ALLOY a2 + ALLOY a3 | | 1070℃ | 13.68 | 17.3 | 97 | 15.41 |
| 78 | Fe-20.6Nd-5.4Pr-4.7Dy-1B-0.05Cu-0.2Al-0.5Co-0.13Zr | | | | 13.19 | 23.23 | 98 | 15.51 |
| 79 | Fe-19.0Nd-5.3Pr-7.2Dy-1B-0.05Cu-0.2Al-0.5Co-0.13Zr | | | 1090℃ | 12.37 | 30.51 | 94 | 15.42 |

FIG. 28

| TYPE | | Nd (wt%) | Pr (wt%) | Dy (wt%) | Co (wt%) | Cu (wt%) | Al (wt%) | B (wt%) | Zr (wt%) | Fe |
|---|---|---|---|---|---|---|---|---|---|---|
| A | LOW R ALLOY | 23.6 | 6.0 | 0.3 | — | 0.05 | 0.23 | 1.1 | 0.11 | bal. |
| | HIGH R ALLOY | 40.6 | — | — | 5.0 | 0.05 | 0.23 | — | — | bal. |
| | COMPOSITION OF SINTERED BODY | 25.0 | 5.3 | 0.3 | 0.5 | 0.05 | 0.23 | 1.0 | 0.10 | bal. |
| B | LOW R ALLOY | 23.6 | 6.0 | 0.3 | — | 0.05 | 0.23 | 1.1 | — | bal. |
| | HIGH R ALLOY | 40.6 | — | — | 5.0 | 0.05 | 0.23 | 0.5 | 2.0 | bal. |
| | COMPOSITION OF SINTERED BODY | 25.0 | 5.3 | 0.3 | 0.5 | 0.05 | 0.23 | 1.1 | 0.10 | bal. |

FIG. 29

| TYPE | Zr ADDING METHOD | Zr ADDITIVE AMOUNT [wt%] | $O_2$ [ppm] | $N_2$ [ppm] | SIZE OF PRODUCT (AVERAGE) | | | SINTERING TEMPERATURE [°C] |
|---|---|---|---|---|---|---|---|---|
| | | | | | MAJOR AXIS [nm] | MINOR AXIS [nm] | AXIS RATIO | |
| A | LOW R ALLOY | 0.1 | 670 | 350 | 310 | 15 | 22.7 | 1050 |
| B | HIGH R ALLOY | 0.1 | 850 | 300 | 166 | 15 | 11.2 | |

FIG. 33

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ | CV VALUE |
|---|---|---|---|---|---|---|---|---|---|---|
| 80 | Fe-28.3Nd-0.1Dy-1B-0.03Cu-0.05Al-0.2Co-0.07Zr | 720 | ALLOY a7 | ALLOY b4 | 1070℃ | 14.62 | 13.1 | 98 | 15.93 | 77 |
| 81 | Fe-26.9Nd-4.8Pr-0.2Dy-1.3B-0.3Cu-0.25Al-4Co-0.24Zr | 980 | ALLOY a8 | ALLOY b5 | 1020℃ | 13.88 | 15.3 | 96 | 15.41 | 98 |

R-T-B SYSTEM RARE EARTH PERMANENT MAGNET

BACKGROUND OF THE INVENTION

1. Field of the Invention

The present invention relates to an R-T-B system rare earth permanent magnet containing, as main components, R (wherein R represents one or more rare earth elements, providing that the rare earth elements include Y), T (wherein T represents at least one transition metal element essentially containing Fe, or Fe and Co), and B (boron).

2. Description of the Related Art

Among rare earth permanent magnets, an R-T-B system rare earth permanent magnet has been increasingly demanded year by year for the reasons that its magnetic properties are excellent and that its main component Nd is abundant as a source and relatively inexpensive.

Research and development directed towards the improvement of the magnetic properties of the R-T-B system rare earth permanent magnet have intensively progressed. For example, Japanese Patent Laid-Open No. 1-219143 discloses that the addition of 0.02 to 0.5 at % of Cu improves magnetic properties of the R-T-B system rare earth permanent magnet as well as heat treatment conditions. However, the method described in Japanese Patent Laid-Open No. 1-219143 is insufficient to obtain high magnetic properties required of a high performance magnet, such as a high coercive force (HcJ) and a high residual magnetic flux density (Br).

The magnetic properties of an R-T-B system rare earth permanent magnet obtained by sintering depend on the sintering temperature. On the other hand, it is difficult to equalize the heating temperature throughout all parts of a sintering furnace in the scale of industrial manufacturing. Thus, the R-T-B system rare earth permanent magnet is required to obtain desired magnetic properties even when the sintering temperature is changed. A temperature range in which desired magnetic properties can be obtained is referred to as a suitable sintering temperature range herein.

In order to obtain a higher-performance R-T-B system rare earth permanent magnet, it is necessary to decrease the amount of oxygen contained in alloys. However, if the amount of oxygen contained in the alloys is decreased, abnormal grain growth is likely to occur in a sintering process, resulting in a decrease in a squareness. This is because oxides formed by oxygen contained in the alloys inhibit the grain growth.

Thus, a method of adding a new element to the R-T-B system rare earth permanent magnet containing Cu has been studied as means for improving the magnetic properties. Japanese Patent Laid-Open No. 2000-234151 discloses the addition of Zr and/or Cr to obtain a high coercive force and a high residual magnetic flux density.

Likewise, Japanese Patent Laid-Open No. 2002-75717 discloses a method of uniformly dispersing a fine ZrB compound, NbB compound or HfB compound (hereinafter referred to as an M-B compound) into an R-T-B system rare earth permanent magnet containing Zr, Nb or Hf as well as Co, Al and Cu, followed by precipitation, so as to inhibit the grain growth in a sintering process and to improve magnetic properties and a suitable sintering temperature range.

According to Japanese Patent Laid-Open No. 2002-75717, the suitable sintering temperature range is extended by the dispersion and precipitation of the M-B compound. However, in Example 3-1 described in the above publication, the suitable sintering temperature range is narrow, such as approximately 20° C. Accordingly, to obtain high magnetic properties using a mass-production furnace or the like, it is desired to further extend the suitable sintering temperature range. Moreover, in order to obtain a sufficiently wide suitable sintering temperature range, it is effective to increase the additive amount of Zr. However, as the additive amount of Zr increases, the residual magnetic flux density decreases, and thus, high magnetic properties of interest cannot be obtained.

SUMMARY OF THE INVENTION

Hence, it is an object of the present invention to provide an R-T-B system rare earth permanent magnet, which enables to inhibit the grain growth, while keeping a decrease in magnetic properties to a minimum, and also enables to further improve the suitable sintering temperature range.

In recent years, a high-performance R-T-B system rare earth permanent magnet has been manufactured mainly by a mixing method, which comprises mixing various types of metallic powders or alloy powders having different compositions, and sintering the obtained mixture. In this mixing method, alloys for formation of a main phase, which contain as a main constituent an $R_2T_{14}B$ system inter metallic compound (wherein R represents one or more rare earth elements, providing that the rare earth elements include Y, and T represents at least one transition metal element containing, as a main constituent, Fe, or Fe and Co), are typically mixed with alloys for formation of a grain boundary phase located between the main phases (hereinafter referred to as "alloys for formation of a grain boundary phase). Since the alloys for formation of a main phase contain a relatively low amount of R, compared with a composition of sintered magnet, they are called low R alloys at times. On the other hand, since the alloys for formation of a grain boundary phase contain a relatively high amount of R, compared with a composition of the sintered magnet, they are called high R alloys at times.

The present inventor confirmed that when an R-T-B system rare earth permanent magnet is obtained by the mixing method, if Zr is contained in the low R alloys, the dispersion of Zr becomes high in the obtained R-T-B system rare earth permanent magnet. The high dispersion of Zr enables the prevention of the abnormal grain growth with a lower content of Zr.

Moreover, the present inventor has confirmed that Zr forms a high-concentration region together with specific elements such as Cu, Co and Nd in an R-T-B system rare earth permanent magnet with a specific composition.

The present invention is made based on the above findings. It provides an R-T-B system rare earth permanent magnet, which comprises a main phase consisting of an $R_2T_{14}B_1$ phase (wherein R represents one or more rare earth elements (provided that the rare earth elements include Y), and T represents at least one transition metal element containing, as a main constituent, Fe or Fe and Co), and a grain boundary phase containing a higher amount of R than said main phase, the above R-T-B system rare earth permanent magnet being a sintered body containing a region that is rich both in at least one element selected from a group consisting of Cu, Co and R, and in Zr.

In this R-T-B system rare earth permanent magnet, the rich region that is rich both in at least one element selected from a group consisting of Cu, Co and R, and in Zr exists in the grain boundary phase.

In addition, with regard to the profile of a line analysis by EPMA, the peak of at least one element selected from a group consisting of Cu, Co and R is coincident with the peak of Zr in the above rich region that is rich both in at least one element selected from a group consisting of Cu, Co and R, and in Zr.

Effects obtained by adding Zr to the low R alloys, such as the improvement of the dispersion of Zr and the extension of the suitable sintering temperature range, become significant when the amount of oxygen contained in said sintered body is as low as 2,000 ppm or less.

The R-T-B system rare earth permanent magnet of the present invention preferably has a composition consisting essentially of 28% to 33% by weight of R, 0.5% to 1.5% by weight of B, 0.03% to 0.3% by weight of Al, 0.3% or less by weight (excluding 0) of Cu, 0.05% to 0.2% by weight of Zr, 4% or less by weight (excluding 0) of Co, and the balance substantially being Fe.

As stated above, the present invention is characterized in that the dispersion of Zr in the sintered body is improved. More specifically, the R-T-B system rare earth permanent magnet of the present invention is a sintered body having a composition essentially consisting of 25% to 35% by weight of R (wherein R represents one or more rare earth elements, provided that the rare earth elements include Y), 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe, wherein a coefficient of variation (CV value) showing the dispersion degree of Zr in the sintered body is 130 or less.

The R-T-B system rare earth permanent magnet of the present invention can have high magnetic properties such that, with regard to a residual magnetic flux density (Br) and a coercive force (HcJ), Br+0.1×HcJ (dimensionless, and so forth) is 15.2 or greater. However, the Br value herein means a value expressed by kG in a CGS system, and the HcJ value herein means a value expressed by kOe in a CGS system.

As described above, according to the R-T-B system rare earth permanent magnet of the present invention, the suitable sintering temperature range is improved. The effect to improve the suitable sintering temperature range is obtained from a compound for magnet in a state of powders (or a compacted body thereof) before being sintered. Accordingly, the suitable sintering temperature range, where the squareness (Hk/HcJ) of the an R-T-B system rare earth permanent magnet obtained by sintering is 90% or more, can be 40° C. or more for this compound for magnet. When this compound for magnet is a mixture of alloys for formation of a main phase and alloys for formation of a grain boundary phase, it is preferable to add Zr to the alloys for formation of a main phase. This is because the addition of Zr to the alloys for formation of a main phase is effective to improve the dispersion of Zr.

The R-T-B system rare earth permanent magnet of the present invention that is a sintered body having a composition consisting essentially of 25% to 35% by weight of R, 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe can be obtained by the following steps. First, in a crushing step, both low R alloys containing an $R_2T_{14}B$ compound as a main constituent and further containing Zr, and high R alloys containing R and T as main constituents are prepared, and the low R alloys and the high R alloys are crushed and pulverized to obtain pulverized powders. Thereafter, the powders obtained by the crushing process are compacted, so as to obtain a compacted body. In the following sintering process, the compacted body is sintered, so as to obtain the R-T-B system rare earth permanent magnet of the present invention.

In this manufacturing method, it is preferable to add Cu and/or Al as well as Zr to the low R alloys.

BRIEF DESCRIPTION OF THE DRAWINGS

FIG. 11 is a table showing the chemical compositions of low R alloys and high R alloys used in Example 1;

FIG. 12 is a table showing the composition, the amount of oxygen, and the magnetic properties of each of the permanent magnets (Nos. 1 to 20) obtained in Example 1;

FIG. 13 is a table showing the composition, the amount of oxygen, and the magnetic properties of each of the permanent magnets (Nos. 21 to 35) obtained in Example 1;

FIG. 19 is a table showing the composition, the amount of oxygen, and the magnetic properties of each of the permanent magnets (Nos. 36 to 75) obtained in Example 2;

FIGS. 21(*a*) to (*d*) are photographs obtained by observing, by SEM (Scanning Electron Microscope), the microstructure in the section of each of the permanent magnets Nos. 37, 39, 43 and 48 obtained in Example 2;

FIG. 27 is a table showing the composition, the amount of oxygen, and the magnetic properties of each of the permanent magnets (Nos. 76 to 79) obtained in Example 3;

FIG. 28 is a table showing the chemical compositions of low R alloys and high R alloys used in Example 4, and the compositions of sintered bodies that are the permanent magnets obtained in Example 4;

FIG. 29 is a table showing the amount of oxygen and the amount of nitrogen of the permanent magnets (types A and B) obtained in Example 4, and the size of products observed in the permanent magnets;

FIG. 33 is a table showing the composition, the amount of oxygen, and the magnetic properties of each of the permanent magnets (Nos. 80 and 81) obtained in Example 5.

DETAILED DESCRIPTION OF THE PREFERRED EMBODIMENTS

Figure 1:
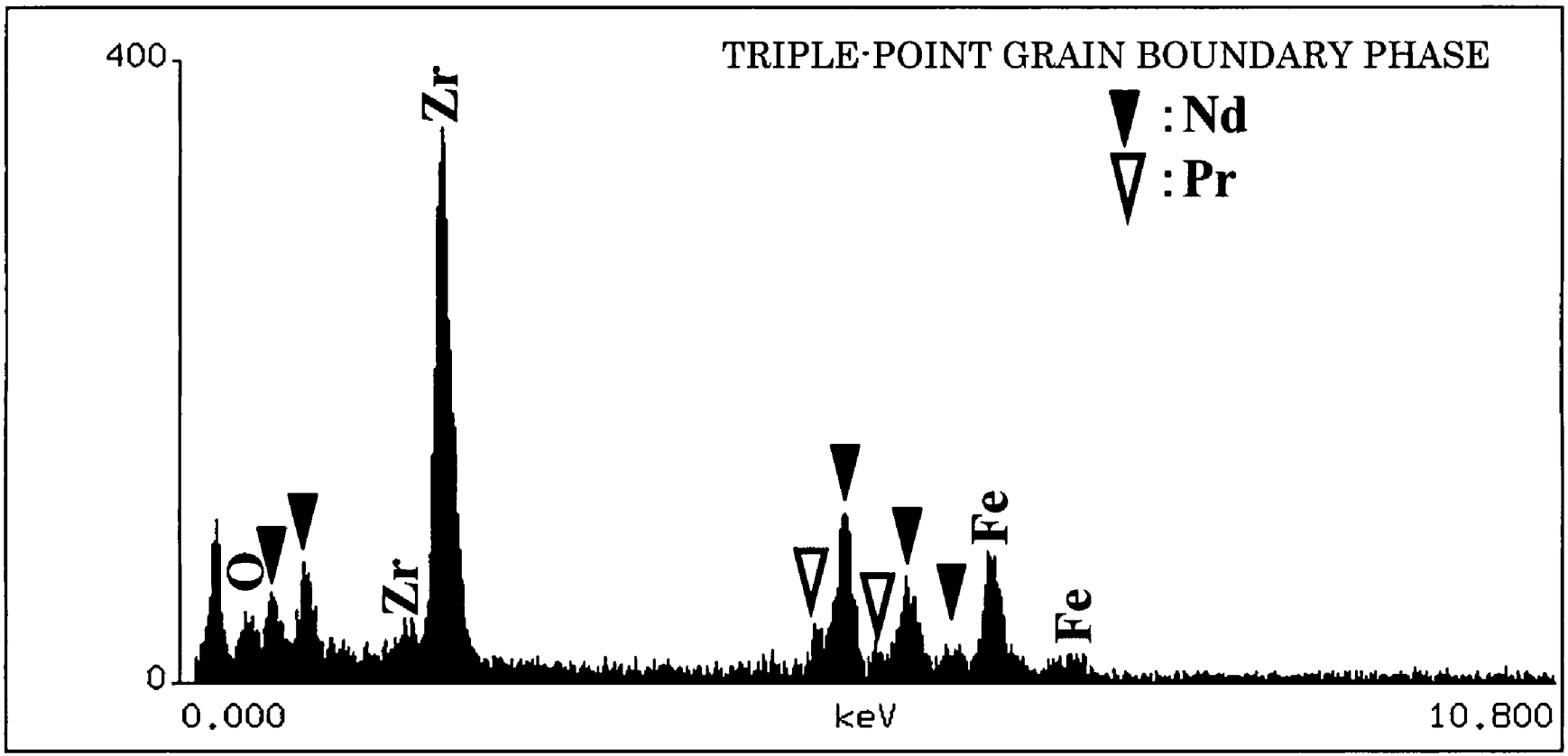
FIG. 1 is a diagram showing an EDS (energy dispersive X-ray analyzer) profile of a product existing in the triple-point grain boundary phase of a permanent magnet (type A) in Example 4.

The embodiments of the present invention will be described below.

<Microstructure>

First, the microstructure of the R-T-B system rare earth permanent magnet that is a feature of the present invention will be explained.

The first feature of the present invention is that Zr is uniformly dispersed in the microstructure of a sintered body. Moreover, the second feature of the present invention is that a region having a higher Zr concentration than in other regions (hereinafter referred to as "Zr rich region") overlaps a region having a higher concentration of specific elements (specifically, Cu, Co and Nd) than in other regions. Furthermore, the third feature of the present invention is that a platy or acicular product exists in the grain boundary phases, the triple-point grain boundary phase and the two-grain grain boundary phase, of the sintered body of the present invention. The first to third features of the present invention will be described in detail below.

(First Feature)

More specifically, the first feature is specified by a coefficient of variation (referred to as a CV (coefficient of variation) value in the specification of the present application). In the present invention, the CV value of Zr is 130 or less, preferably 100 or less, and more preferably 90 or less. The smaller the CV value, the higher the dispersion of Zr that can be obtained. As is well known, the CV value is a value (percentage) obtained by dividing a standard deviation by an arithmetic mean value. In addition, the CV value in the present invention is obtained under measurement conditions in Examples described later.

Thus, the high dispersion of Zr results from a method of adding Zr. As described later, the R-T-B system rare earth permanent magnet of the present invention can be manufactured by a mixing method. The mixing method comprises mixing low R alloys for formation of a main phase with high R alloys for formation of a grain boundary phase. Comparing with the case of adding Zr to the high R alloys, the dispersion is significantly improved when Zr is added to the low R alloys.

Since the dispersion of Zr is high in the R-T-B system rare earth permanent magnet of the present invention, the R-T-B system rare earth permanent magnet is able to exert the effect to inhibit the grain growth even with the addition of a smaller amount of Zr.

(Second Feature)

Next, the second feature will be explained. It was confirmed for the R-T-B system rare earth permanent magnet of the present invention that (1) a Zr rich region is also rich in Cu, (2) a Zr rich region is rich in both Cu and Co, or (3) a Zr rich region is rich all in Cu, Co and Nd. In particular, it is highly probable that the region is rich in both Zr and Cu. Thus, Zr coexists with Cu, thereby exerting its effect. Moreover, all Nd, Co and Cu are elements that form a grain boundary phase. Accordingly, from the fact that the region is rich in Zr, it is determined that Zr exists in the grain boundary phase.

The reason why Zr has the above described relationship with Cu, Co and Nd is uncertain, but the following assumption can be made.

According to the present invention, a liquid phase that is rich both in one or more of Cu, Nd and Co, and in Zr (hereinafter referred to as "Zr rich liquid phase") is generated in a sintering process. In terms of wetting property to $R_2T_{14}B_1$ crystal grains (compound), this Zr rich liquid phase differs from a liquid phase in a common system that does not contain Zr. This becomes a factor for slowing the speed of grain growth in the sintering process. Accordingly, the Zr rich liquid phase can inhibit the grain growth and prevent the occurrence of abnormal grain growth. At the same time, the Zr rich liquid phase enables to improve the suitable sintering temperature range, and thereby it becomes possible to easily manufacture an R-T-B system rare earth permanent magnet with high magnetic properties.

By forming a grain boundary phase that is rich both in one or more of Cu, Nd and Co, and in Zr, the above described effects can be obtained. Accordingly, Zr can be dispersed more uniformly and finely than when it is present in a solid state (oxide, boride, etc.) in the sintering process. Thus, the required additive amount of Zr can be reduced, and further, a large amount of different phase that decreases the ratio of a main phase is not generated. Accordingly, it is assumed that the decrease of magnetic properties such as a residual magnetic flux density (Br) does not take place.

(Third Feature)

The third feature of the present invention will be explained below.

As is well known, the R-T-B system rare earth permanent magnet of the present invention is comprised of a sintered body at least containing a main phase consisting of an $R_2T_{14}B$ phase (wherein R represents one or more rare earth elements, and T represents one or more types of transition metal elements essentially containing Fe, or Fe and Co), and a grain boundary phase containing a higher amount of R than the main phase. In the present invention, Y is included in the rare earth elements.

The R-T-B system rare earth permanent magnet of the present invention contains a triple-point grain boundary phase and a two-grain grain boundary phase that are the grain boundary phases of a sintered body. In the triple-point grain boundary phase and the two-grain grain boundary phase, a product having the following features exists. The presence of this product is the third feature of the R-T-B system rare earth permanent magnet of the present invention.

Figure 2:
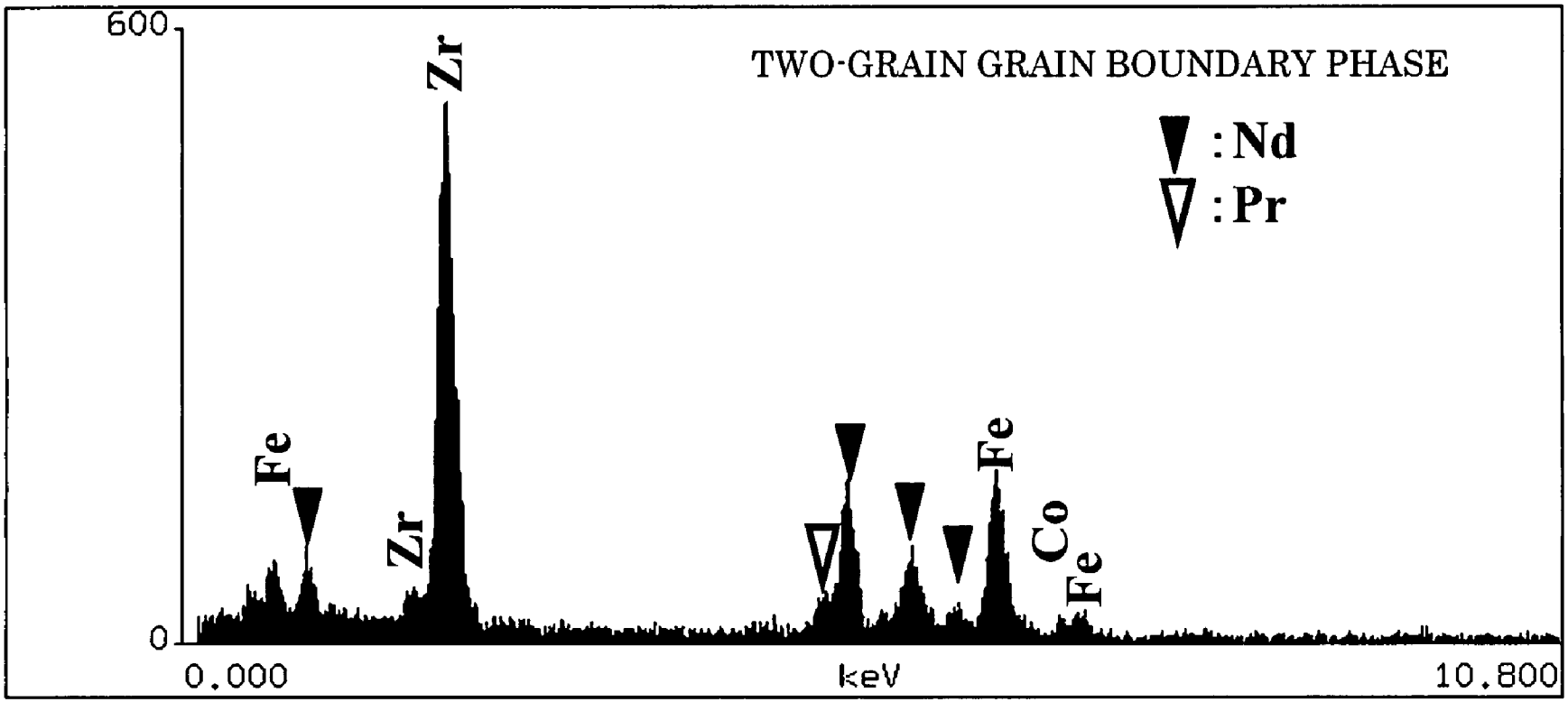
FIG. 2 is a diagram showing an EDS profile of a product existing in the two-grain grain boundary phase of a permanent magnet (type A) in Example 4.

FIGS. 1 and 2 show EDS (energy dispersive X-ray analyzer) profiles of a product existing in the triple-point grain boundary phase and a product existing in the two-grain grain boundary phase of the R-T-B system rare earth permanent magnet of type A in Example 4 described later. The type A is manufactured by applying a mixing method, and further adding Zr to the low R alloys. In addition, FIGS. 3 to 9 as shown below are also based on the observation of the R-T-B system rare earth permanent magnet of type A in Example 4 described later.

As shown in FIGS. 1 and 2, this product is rich in Zr and further contains Nd as R and Fe as T. In a case where the R-T-B system rare earth permanent magnet contains Co or Cu, these elements may be contained in the product.

Figure 3:
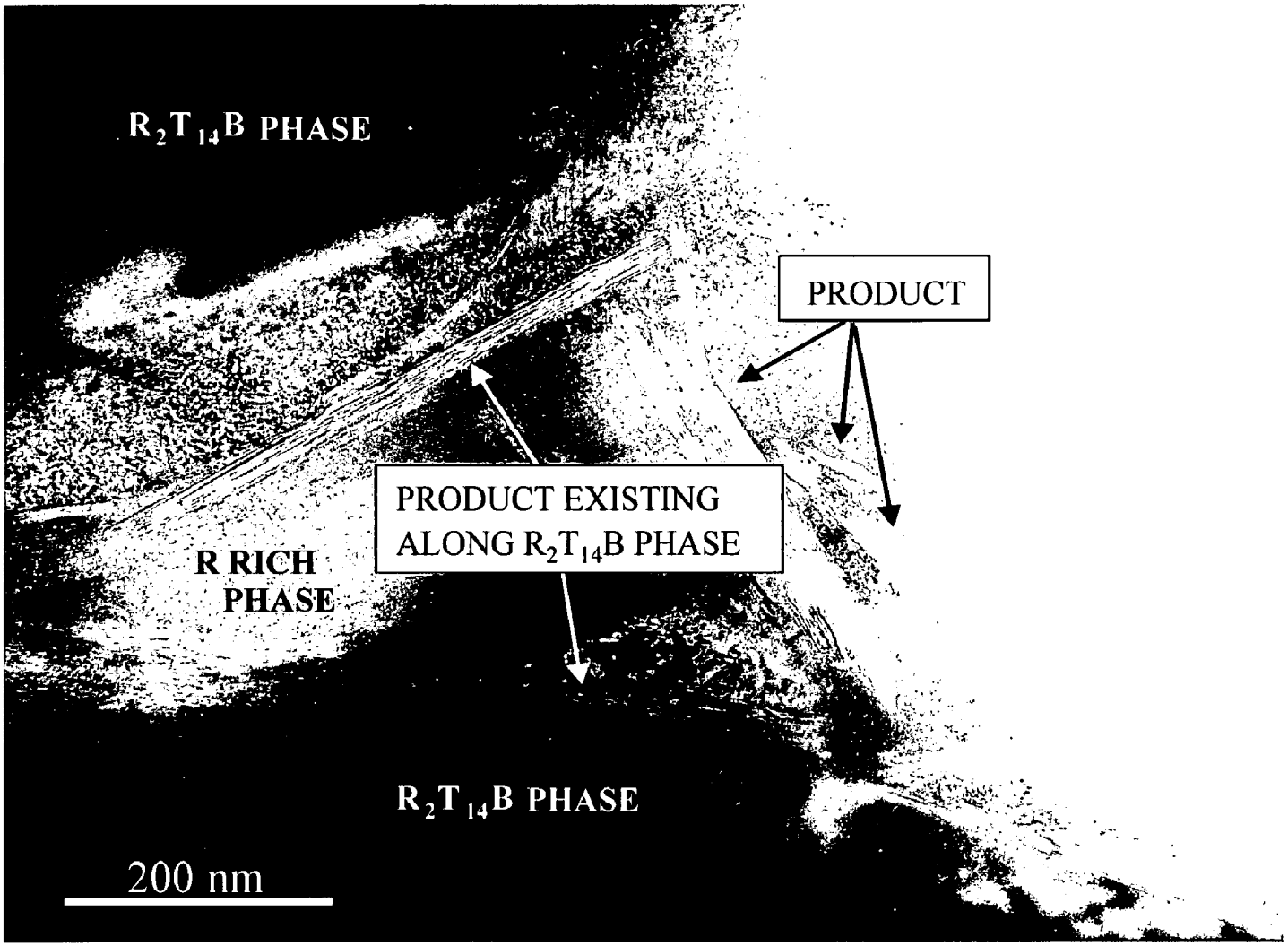
FIG. 3 is a TEM (Transmission Electron Microscope) photograph of the triple-point grain boundary phase and periphery thereof, of a permanent magnet (type A) in Example 4.
Figure 4:
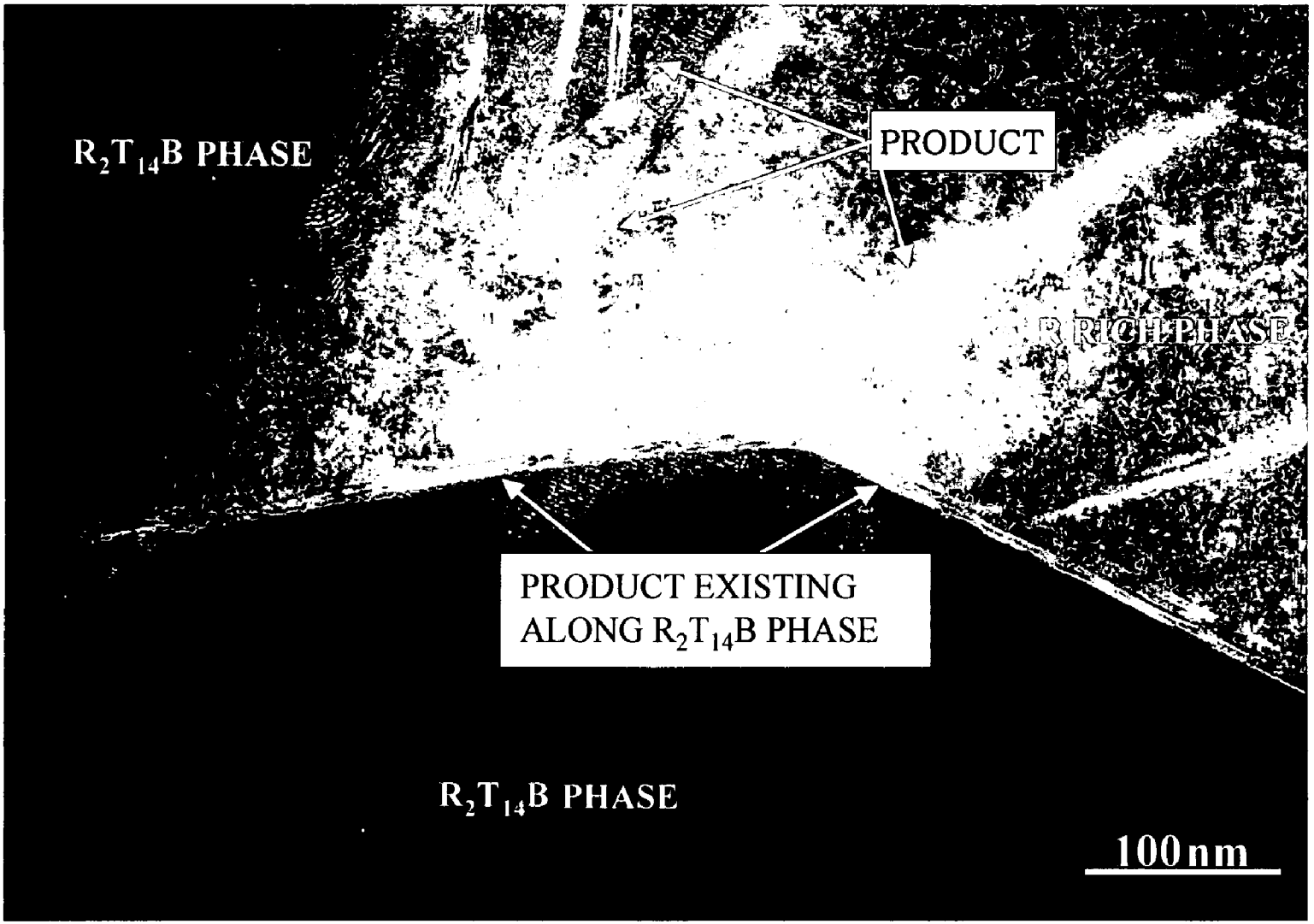
FIG. 4 is another TEM photograph of the triple-point grain boundary phase and periphery thereof, of a permanent magnet (type A) in Example 4.
Figure 5:
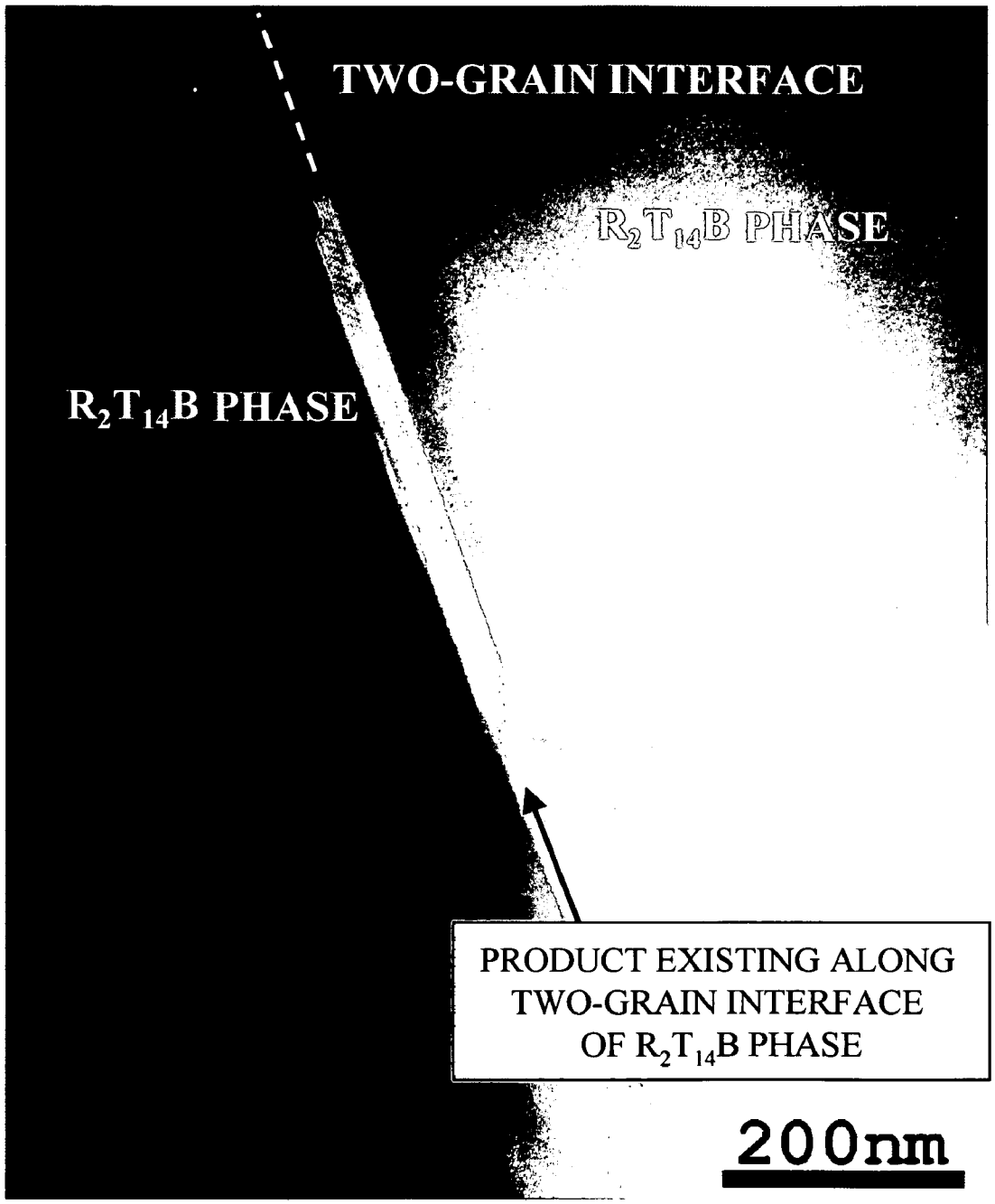
FIG. 5 is a TEM photograph of the two-grain interface and periphery thereof, of a permanent magnet (type A) in Example 4.
Figure 6:
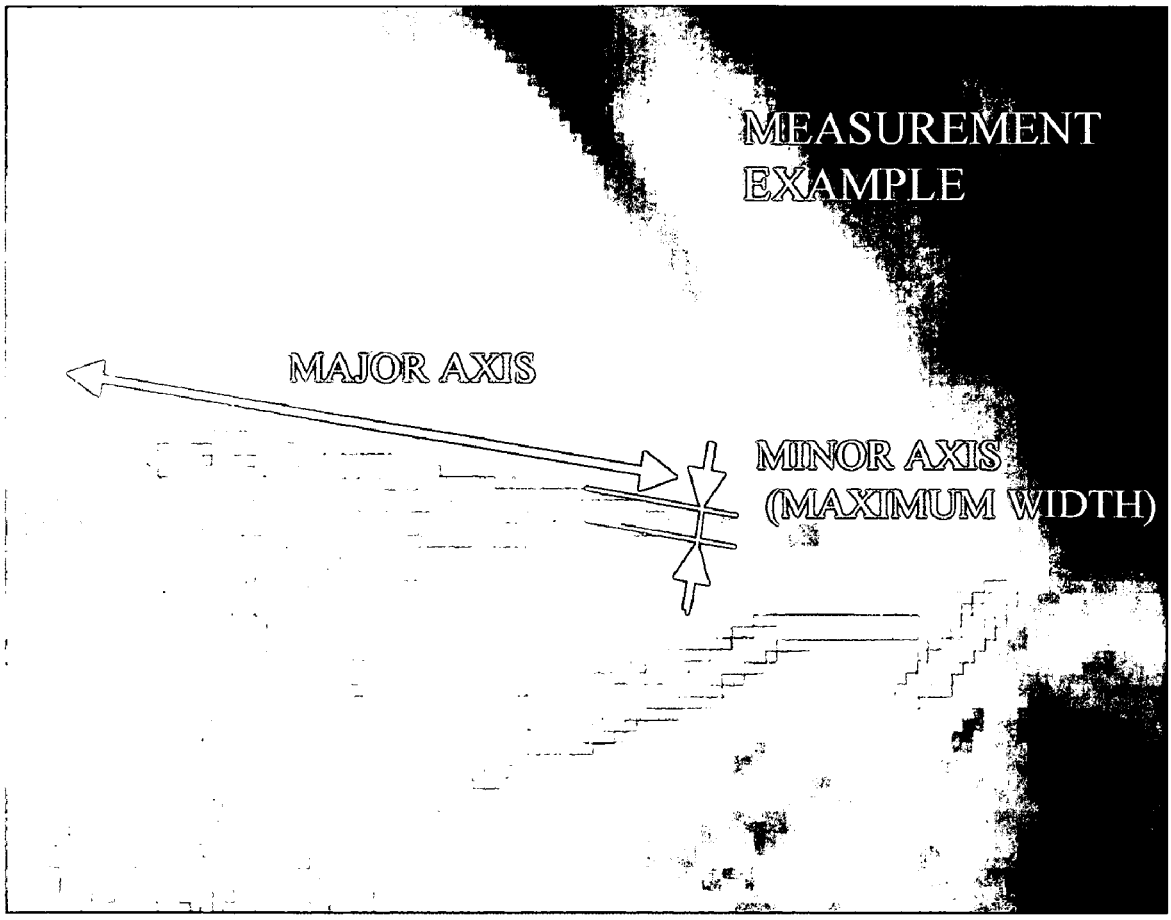
FIG. 6 is a figure showing a method for measuring the major axis and minor axis of a product.

Each of FIGS. 3 and 4 is a TEM (Transmission Electron Microscope) photograph of the triple-point grain boundary phase and periphery thereof, of the permanent magnet of type A. FIG. 5 is a TEM photograph of the two-grain interface and periphery thereof, of the permanent magnet of type A. As shown in FIGS. 3 to 5, this product has a platy or acicular form. The determination of the form of the product is based on the observation of a cross section of the sintered body. Accordingly, it is difficult to determine from this observation whether the form is platy or acicular, and therefore, the form is described as being platy or acicular. This platy or acicular product has a major axis of 30 to 600 nm, a minor axis of 3 to 50 nm, and an axis ratio (major axis/minor axis) of 5 to 70. A method for measuring the major axis and minor axis of the product is shown in FIG. 6.

Figure 7:
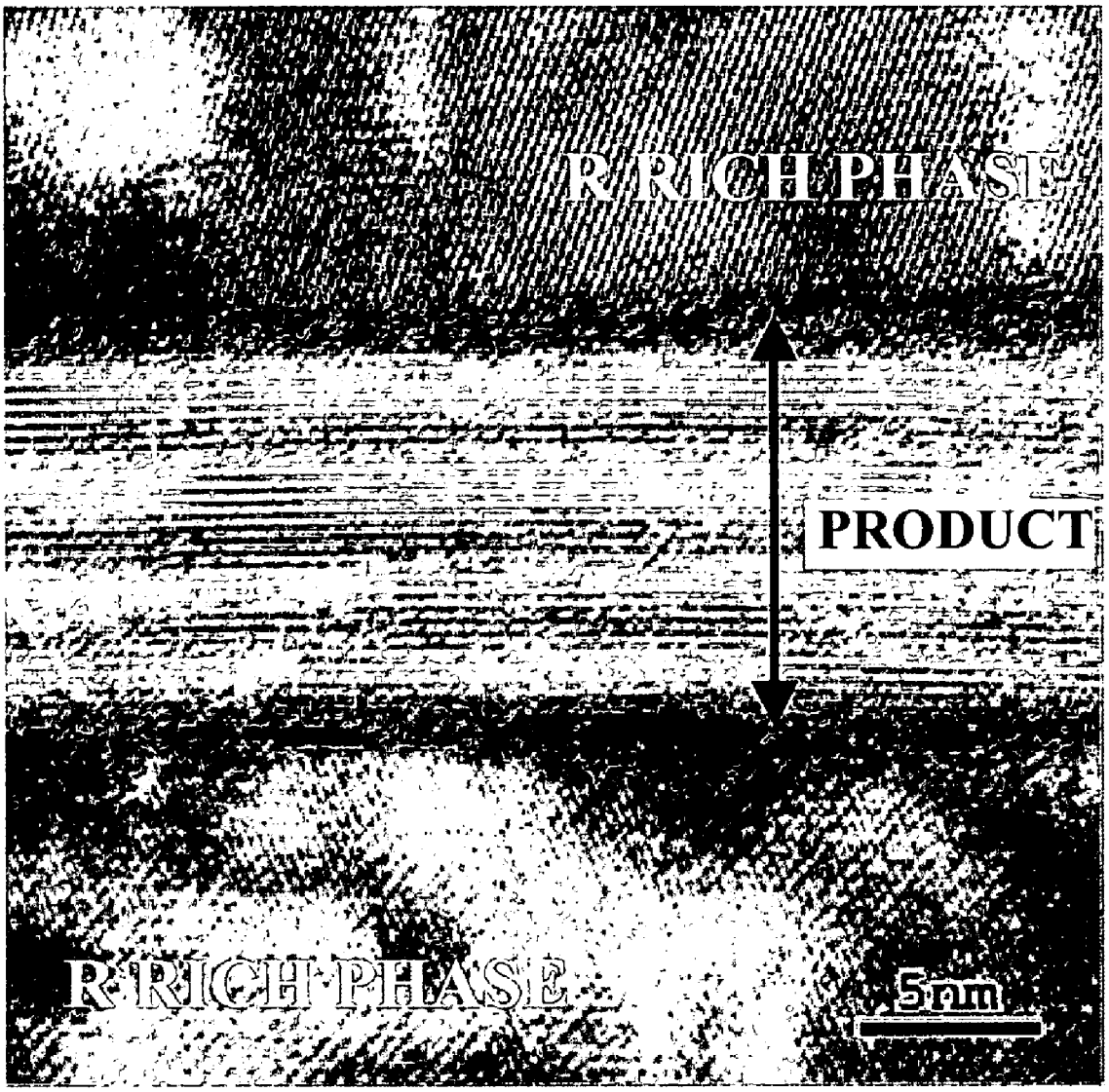
FIG. 7 is a high resolution TEM photograph of the triple-point grain boundary phase and periphery thereof, of a permanent magnet (type A) in Example 4.

FIG. 7 is a high resolution TEM photograph of the triple-point grain boundary phase and periphery thereof, of the R-T-B system rare earth permanent magnet of type A. As explained later, this product has a periodic fluctuation of the composition in the minor axis direction (in the direction of the arrow as shown in FIG. 7).

Figure 8:
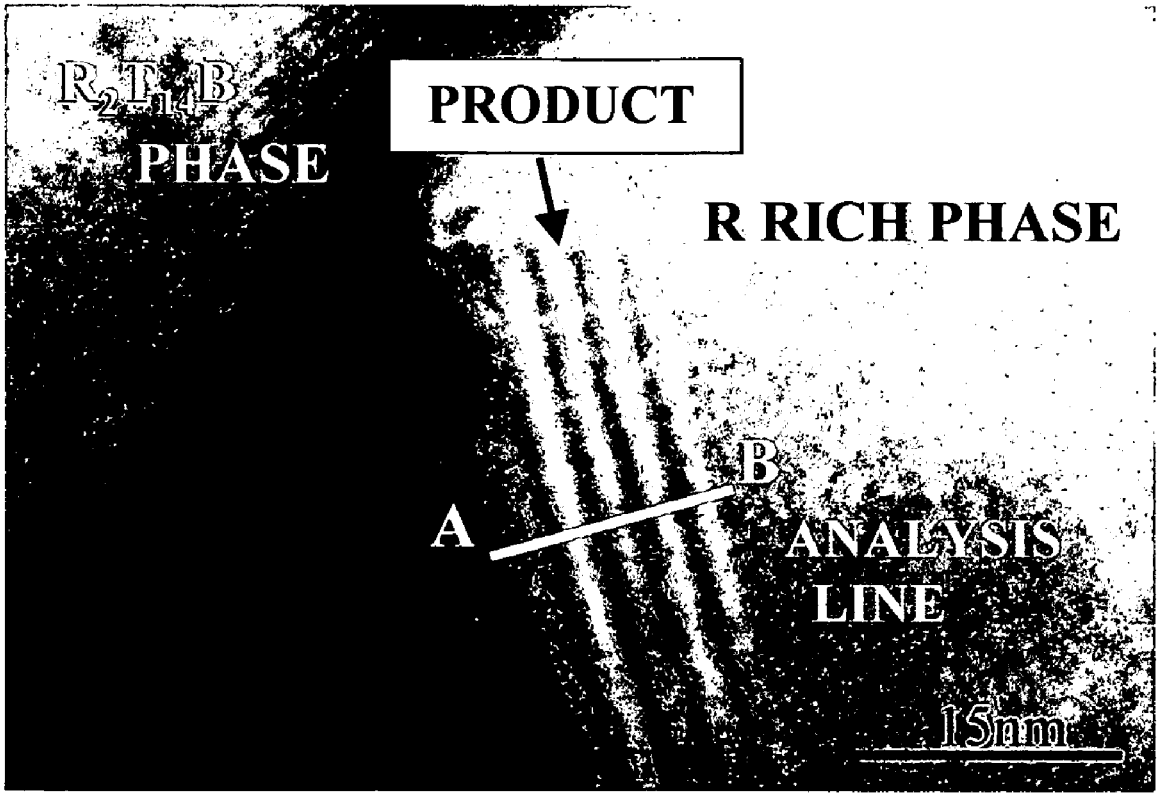
FIG. 8 is an STEM (Scanning Transmission Electron Microscope) photograph of the triple-point grain boundary phase and periphery thereof, of a permanent magnet (type A) in Example 4.
Figure 9:
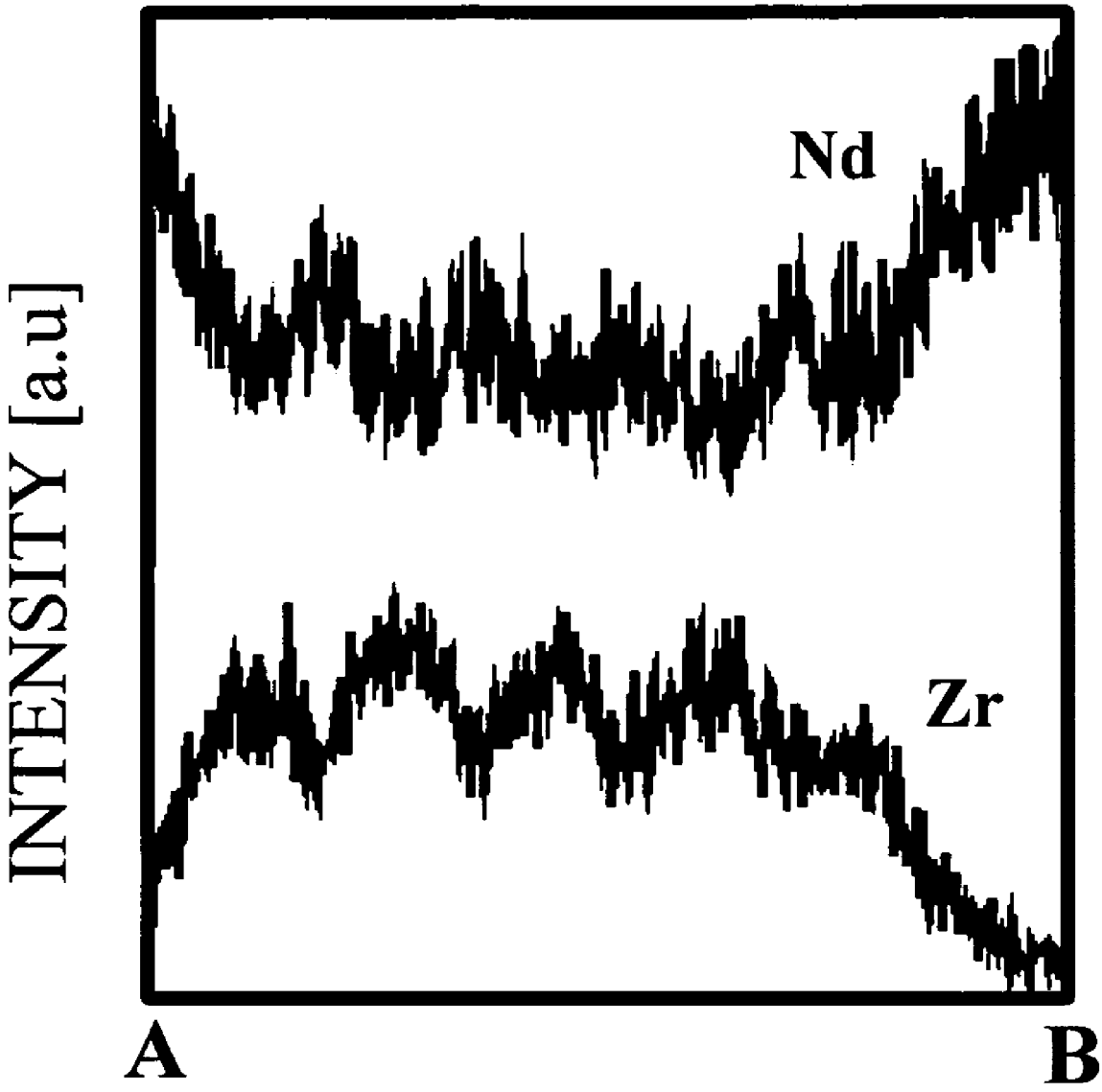
FIG. 9 is a diagram showing the results of a line analysis of the product shown in FIG. 8 by STEM-EDS.

FIG. 8 is an STEM (Scanning Transmission Electron Microscope) photograph of the product. FIG. 9 shows a concentration distribution of Nd and Zr expressed by change in the intensity of the spectrum of Nd-L$\alpha$ and Zr-L$\alpha$ lines that is obtained when an EDS line analysis is carried out on an analysis line A-B crossing over the product shown in FIG. 8. As shown in FIG. 9, in this product, the concentration of Nd (R) is low in the region where the concentration of Zr is high. In contrast, the concentration of Nd (R) is high in the region where the concentration of Zr is low. Thus, it can be seen that the product shows a periodic fluctuation of the composition in which Zr and Nd (R) are involved.

The presence of the product enables to extend the suitable sintering temperature range, while inhibiting the decrease of the residual magnetic flux density.

The reason why the presence of the product enables the extension of the suitable sintering temperature range is uncertain at this stage, but the following assumption can be made.

Figure 10:
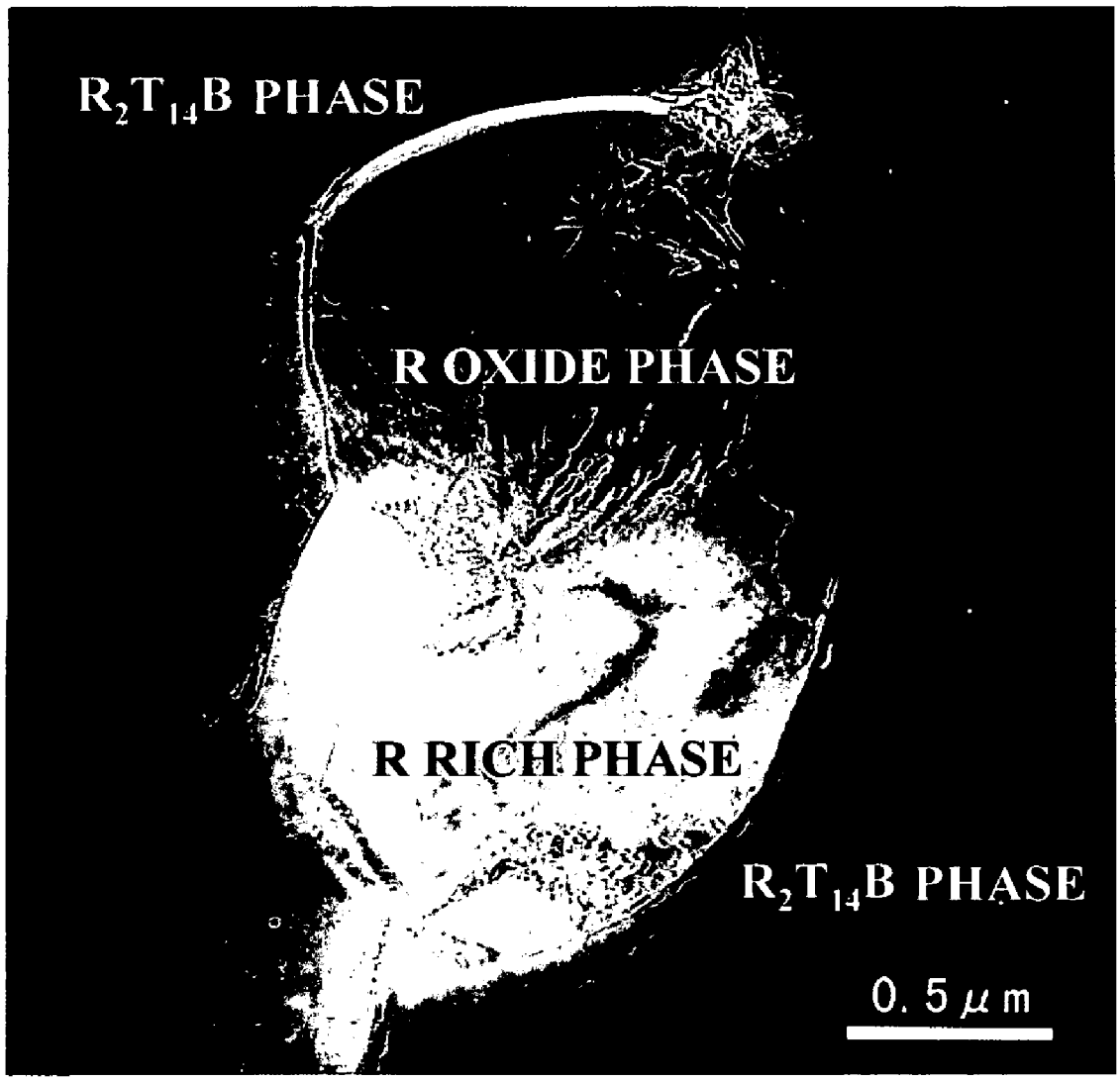
FIG. 10 is a TEM photograph of a rare earth oxide existing in the triple-point grain boundary phase of a permanent magnet.

In an R-T-B system rare earth permanent magnet containing oxygen of 3,000 ppm or more, the grain growth is inhibited by the presence of a rare earth oxide phase. The form of the rare earth oxide phase is almost spherical, as shown in FIG. 10. Even when the amount of oxygen is reduced without adding Zr, if the remaining amount of oxygen is approximately 1,500 to 2,000 ppm, high magnetic properties can still be obtained. In this case, however, the suitable sintering temperature range is extremely narrow. When the amount of oxygen is further reduced to 1,500 ppm or lower, grains significantly grow during the sintering process, and accordingly, it becomes difficult to obtain high magnetic properties. It is possible to decrease the sintering temperature and to carry out sintering for a long time, so as to obtain high magnetic properties. However, this is not industrially practical.

Contrary to the above methods, the behavior in a Zr addition system will be considered. Even when Zr is added to a common R-T-B system rare earth permanent magnet, its effect to inhibit the grain growth is not observed. As the additive amount is increased, the residual magnetic flux density is decreased. However, when the amount of oxygen is reduced from an R-T-B system rare earth permanent magnet to which Zr is added, high magnetic properties can be obtained in a wide suitable sintering temperature range. Accordingly, compared with the amount of oxygen, the addition of a small amount of Zr inhibits the grain growth more sufficiently.

From these facts, it can be said that the effect of adding Zr appears, when the amount of oxygen is reduced and thereby the amount of the formed rare earth oxide phase is significantly reduced. That is to say, it is considered that Zr forms a product which plays the role of the rare earth oxide phase.

Moreover, as described later in Example 4, the present product has an anisotropic form. The ratio between its longest diameter (major axis) and the diameter (minor axis) obtained by cutting with a line orthogonal to the longest diameter, that is, an axis ratio (=major axis/minor axis) is extremely large. Thus, the form of the present product significantly differs from the isotropic form of a rare earth oxide (e.g., a spherical, in this case, the axis ratio is almost 1). Accordingly, the present product has a high probability to contact with an $R_2T_{14}B$ phase, and further, the surface area of the product is larger than that of a spherical rare earth oxide. It is therefore considered that the present product inhibits the movement of grains through the grain boundary that is necessary for the grain growth, and that the suitable sintering temperature range is thereby extended only by the addition of a small amount of Zr.

As described above, a product that is rich in Zr and has a large axis ratio is allowed to exist in the triple-point grain boundary phase or two-grain grain boundary phase of an R-T-B system rare earth permanent magnet containing Zr, so that the growth of the $R_2T_{14}B$ phase is inhibited during the sintering process, thereby the suitable sintering temperature range is improved. Therefore, according to the third feature of the present invention, a heat treatment on a large permanent magnet and a stable manufacturing of an R-T-B system rare earth permanent magnet using such a large heat treatment furnace can be easily carried out.

Moreover, by increasing the axis ratio of the product, although only a small amount of Zr is added, it exerts its effect sufficiently. Accordingly, an R-T-B system rare earth permanent magnet with high magnetic properties can be manufactured without causing the decrease of the residual magnetic flux density. This effect can be sufficiently exerted, when the concentration of oxygen in alloys or during the manufacturing process is reduced.

The first to third features of the R-T-B system rare earth permanent magnet of the present invention are described in detail as above. In the R-T-B system rare earth permanent magnet of the present invention, a liquid phase generated during the sintering process that is rich both in one or more types of Cu, Nd and Co, and in Zr, that is, a Zr rich liquid phase itself is easily dispersed. Accordingly, the abnormal grain growth can be prevented by adding a smaller amount of Zr. The wetting property of this Zr rich liquid phase to $R_2T_{14}B_1$ crystal grains (compound) differs from that of the liquid phase of a common Zr non-containing system. This is a factor to decrease the speed of the grain growth in the sintering process.

In addition, Zr existing in type A is first considerably uniformly dispersed in a mother alloy, and it is then concentrated in a grain boundary phase (liquid phase) in the sintering process. A nucleation begins in the liquid phase and then reaches the grain growth. Thus, a product extends to the easy-crystal grain growth direction because the crystal grows following a nucleation. This product exists in a grain boundary phase and has an extremely large axis ratio.

That is to say, in the R-T-B system rare earth permanent magnet of the present invention, a liquid phase containing Zr is likely to be uniformly dispersed, and a product with a large axis ratio is formed from the liquid phase. The presence of this product effectively inhibits the grain growth in the sintering process and prevents the occurrence of the abnormal grain growth. Thus, the suitable sintering temperature range is improved by inhibiting the growth of the $R_2T_{14}B$ phase in the sintering process.

<Chemical Composition>

Next, a desired composition of the R-T-B system rare earth permanent magnet of the present invention will be explained. The term chemical composition is used herein to mean a chemical composition obtained after sintering. As described later, the R-T-B system rare earth permanent magnet of the present invention can be manufactured by a mixing method. Each of the low R alloys and the high R alloys will be explained in the description of the manufacturing method.

The rare earth permanent magnet of the present invention contains 25% to 35% by weight of R.

The term R is used herein to mean one or more rare earth elements selected from a group consisting of La, Ce, Pr, Nd, Sm, Eu, Gd, Tb, Dy, Ho, Er, Yb, Lu and Y. If the amount of R is less than 25% by weight, an $R_2T_{14}B_1$ phase as a main phase of the rare earth permanent magnet is not sufficiently generated. Accordingly, α-Fe or the like having soft magnetism is deposited and the coercive force significantly decreases. On the other hand, if the amount of R exceeds 35% by weight, the volume ratio of the $R_2T_{14}B_1$ phase as a main phase decreases, and the residual magnetic flux density decreases. Moreover, if the amount of R exceeds 35% by weight, R reacts with oxygen, and the content of oxygen thereby increases. In accordance with the increase of the oxygen content, an R rich phase effective for the generation of coercive force decreases, resulting in a reduction in the coercive force. Therefore, the amount of R is set between 25% and 35% by weight. The amount of R is preferably between 28% and 33% by weight, and more preferably between 29% and 32% by weight.

Since Nd is abundant as a source and relatively inexpensive, it is preferable to use Nd as a main component of R. Moreover, since the containment of Dy increases an anisotropic magnetic field, it is effective to contain Dy to improve the coercive force. Accordingly, it is desired to select Nd and Dy for R and to set the total amount of Nd and Dy between 25% and 33% by weight. In addition, in the above range, the amount of Dy is preferably between 0.1% and 8% by weight. It is desired that the amount of Dy is arbitrarily determined within the above range, depending on which is more important, a residual magnetic flux density or a coercive force. This is to say, when a high residual magnetic flux density is required to be obtained, the amount of Dy is preferably set between 0.1% and 3.5% by weight. When a high coercive force is required to be obtained, it is preferably set between 3.5% and 8% by weight.

Moreover, the rare earth permanent magnet of the present invention contains 0.5% to 4.5% by weight of boron (B). If the amount of B is less than 0.5% by weight, a high coercive force cannot be obtained. However, if the amount of B exceeds 4.5% by weight, the residual magnetic flux density is likely to decrease. Accordingly, the upper limit is set at 4.5% by weight. The amount of B is preferably between 0.5% and 1.5% by weight, and more preferably between 0.8% and 1.2% by weight.

The R-T-B system rare earth permanent magnet of the present invention may contain Al and/or Cu within the range between 0.02% and 0.6% by weight. The containment of Al and/or Cu within the above range can impart a high coercive force, a strong corrosion resistance, and an improved temperature stability of magnetic properties to the obtained permanent magnet. When Al is added, the additive amount of Al is preferably between 0.03% and 0.3% by weight, and more preferably between 0.05% and 0.25% by weight. When Cu is added, the additive amount of Cu is 0.3% or less by weight (excluding 0), preferably 0.15% or less by weight (excluding 0), and more preferably between 0.03% and 0.08% by weight.

The R-T-B system rare earth permanent magnet of the present invention contains 0.03% to 0.25% by weight of Zr. When the content of oxygen is reduced to improve the magnetic properties of the R-T-B system rare earth permanent magnet, Zr exerts the effect of inhibiting the abnormal grain growth in a sintering process and thereby makes the microstructure of the sintered body uniform and fine. Accordingly, when the amount of oxygen is low, Zr fully exerts its effect. The amount of Zr is preferably between 0.05% and 0.2% by weight, and more preferably between 0.1% and 0.15% by weight.

The R-T-B system rare earth permanent magnet of the present invention contains 2,000 ppm or less oxygen. If it contains a large amount of oxygen, an oxide phase that is a non-magnetic component increases, thereby decreasing magnetic properties. Thus, in the present invention, the amount of oxygen contained in a sintered body is set at 2,000 ppm or less, preferably 1,500 ppm or less, and more preferably 1,000 ppm or less. However, when the amount of oxygen is simply decreased, an oxide phase having a grain growth inhibiting effect decreases, so that the grain growth easily occurs in a process of obtaining full density increase during sintering. Thus, in the present invention, the R-T-B system rare earth permanent magnet to contains a certain amount of Zr, which exerts the effect of inhibiting the abnormal grain growth in a sintering process.

The R-T-B system rare earth permanent magnet of the present invention contains Co in an amount of 4% or less by weight (excluding 0), preferably between 0.1% and 2.0% by weight, and more preferably between 0.3% and 1.0% by weight. Co forms a phase similar to that of Fe. Co has an effect to improve Curie temperature and the corrosion resistance of a grain boundary phase.

<Manufacturing Method>

Next, the suitable method for manufacturing an R-T-B system rare earth permanent magnet of the present invention will be explained.

Embodiments of the present invention show a method for manufacturing a rare earth permanent magnet using alloys (low R alloys) containing an $R_2T_{14}B$ phase as a main phase and other alloys (high R alloys) containing a higher amount of R than the low R alloys.

A raw material is first subjected to strip casting in a vacuum or an inert gas atmosphere, or preferably an Ar atmosphere, so that low R alloys and high R alloys are obtained. Examples of a raw material to be used may include rare earth metals, rare earth alloys, pure iron, ferroboron, and their alloys. When solidification and segregation are observed in the obtained starting mother alloys, the alloys are subjected to a solution treatment, as necessary. As conditions for the treatment, the starting mother alloys may be kept within a temperature range between 700° C. and 1,500° C. in a vacuum or Ar atmosphere for 1 hour or longer.

The characteristic matter of the present invention is that Zr is added to the low R alloys. As described in the above chapter <Microstructure>, the dispersion of Zr in a sintered body can be improved by adding Zr to the low R alloys. Moreover, the addition of Zr to the low R alloys enables the generation of a product having a great effect to inhibit the grain growth and further having a large axis ratio.

The low R alloys can contain Cu and Al as well as R, T and B. When the low R alloys contain the above components, they constitute R—Cu—Al—Zr—T (Fe)—B system alloys. On the other hand, the high R alloys can contain Cu, Co and Al as well as R, T (Fe) and B. When the high R alloys contain the above components, they constitute R—Cu—Co—Al—T (Fe—Co)—B system alloys.

After preparing the low R alloys and the high R alloys, these master alloys are crushed separately or together. The crushing step comprises a crushing process and a pulverizing process. First, each of the master alloys is crushed to a particle size of approximately several hundreds of μm. The crushing is preferably carried out in an inert gas atmosphere, using a stamp mill, a jaw crusher, a brown mill, etc. In order to improve rough crushability, it is effective to carry out crushing after the absorption of hydrogen. Otherwise, it is also possible to release hydrogen after absorbing it and then carry out crushing.

After carrying out the crushing, the routine proceeds to a pulverizing process. In the pulverizing process, a jet mill is mainly used, and crushed powders with a particle size of approximately several hundreds of μm are pulverized to a mean particle size between 3 and 5 μm. The jet mill is a method comprising releasing a high-pressure inert gas (e.g., nitrogen gas) from a narrow nozzle so as to generate a high-speed gas flow, accelerating the crushed powders with the high-speed gas flow, and making crushed powders hit against each other, the target, or the wall of the container, so as to pulverize the powders.

When the low R alloys and the high R alloys are pulverized separately in the pulverizing process, the pulverized low R alloy powders are mixed with the pulverized high R alloys powders in a nitrogen atmosphere. The mixing ratio of the low R alloy powders and the high R alloy powders may be approximately between 80:20 and 97:3 at a weight ratio. Likely, in a case where the low R alloys are pulverized together with the high R alloys, the mixing ratio may be approximately between 80:20 and 97:3 at a weight ratio. When approximately 0.01% to 0.3% by weight of additive agents such as zinc stearate is added during the pulverizing process, fine powders which are well oriented, can be obtained during compacting.

Subsequently, mixed powders comprising of the low R alloy powders and the high R alloy powders are filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe.

After the mixed powders are compacted in the magnetic field, the compacted body is sintered in a vacuum or an inert gas atmosphere. The sintering temperature needs to be adjusted depending on various conditions such as a composition, a crushing method, the difference between particle size and particle size distribution, but the sintering may be carried out at 1,000° C. to 1,100° C. for about 1 to 5 hours.

After completion of the sintering, the obtained sintered body may be subjected to an aging treatment. The aging treatment is important for the control of a coercive force. When the aging treatment is carried out in two steps, it is effective to retain the sintered body for a certain time at around 800° C. and around 600° C. When a heat treatment is carried out at around 800° C. after completion of the sintering, the coercive force increases. Accordingly, it is particularly effective in the mixing method. Moreover, when a heat treatment is carried out at around 600° C., the coercive force significantly increases. Accordingly, when the aging treatment is carried out in a single step, it is appropriate to carry out it at around 600° C.

The rare earth permanent magnet of the present invention, which has the above composition and is manufactured by the above manufacturing method, can have high magnetic properties regarding a residual magnetic flux density (Br) and a coercive force (HcJ), such that Br+0.1×HcJ is 15.2 or more, and further, 15.4 or more.

EXAMPLES

The present invention will be further described in the following Examples. The R-T-B system rare earth permanent magnet of the present invention will be explained in the following Examples 1 to 5. However, since the prepared alloys and each manufacturing process are considerably common in all the Examples, first, these common points will be explained.

(1) Mother Alloys

Thirteen types of alloys shown in FIG. 11 were prepared by the strip casting method.

(2) Hydrogen Crushing Process

A hydrogen crushing treatment was carried out, in which after hydrogen was absorbed at room temperature, dehydrogenation was carried out thereon at 600° C. for 1 hour in an Ar atmosphere.

To control the amount of oxygen contained in a sintered body to 2,000 ppm or less, so as to obtain high magnetic properties, in the present experiments, the atmosphere was controlled at an oxygen concentration less than 100 ppm throughout processes, from a hydrogen treatment (recovery after a crushing process) to sintering (input into a sintering furnace). Hereinafter, this process is referred to as an "oxygen-free process."

(3) Crushing Step

Generally, two-step crushing is carried out, which includes crushing process and pulverizing process. However, since the crushing process could not be carried out in an oxygen-free process, the crushing process was omitted in the present Examples.

Additive agents are mixed before carrying out the pulverizing process. The type of additive agents is not particularly limited, and those contributing to the improvement of crushability and the improvement of orientation during compacting may be appropriately selected. In the present examples, 0.05% to 0.1% zinc stearate was mixed. The mixing of additive agents may be carried out, for example, for 5 to 30 minutes, using a Nauta Mixer or the like.

Thereafter, the alloy powders were subjected to pulverizing process to a mean particle size of approximately 3 to 6 μm using a jet mill. In the present experiments, there were used two types of pulverized powders, having a mean particle size of either 4 μm or 5 μm.

Needless to say, both the additive agent mixing process and the pulverizing process were carried out in an oxygen-free process.

(4) Mixing Process

In order to efficiently carry out the experiments, in some cases, several types of pulverized powders are prepared and mixed, so that the resultant product has a desired composition (especially regarding the amount of Zr). Even in these cases, the mixing of additive agents may be carried out, for example, for 5 to 30 minutes, using a Nauta Mixer or the like.

The process is preferably carried out in an oxygen-free process. However, in a case where the content of oxygen in a sintered body is somewhat increased, the amount of oxygen contained in fine powders used for compacting is adjusted in this mixing process. For example, fine powders having the same composition and the same mean particle size were prepared, and the powders were then left in an 100 ppm or more oxygen-containing atmosphere for several minutes to several hours, so as to obtain fine powders containing several thousands of ppm oxygen. These two types of fine powders are mixed in an oxygen-free process to adjust the amount of oxygen. In Example 1, each permanent magnet was manufactured by the above described method.

(5) Compacting Process

The obtained fine powders are compacted in a magnetic field. More specifically, the fine powders were filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe. In the present experiments, the compacting was carried out by applying a pressure of 1.2 t/cm$^2$ in a magnetic field of 15 kOe, so as to obtain a compacted body. The present process was also carried out in an oxygen-free process.

(6) Sintering and Aging Processes

The obtained compacted body was sintered at 1,010° C. to 1,150° C. for 4 hours in a vacuum atmosphere, followed by quenching. Thereafter, the obtained sintered body was subjected to a two-step aging treatment consisting of treatments of 800° C.×1 hour and 550° C.×2.5 hours (both in an Ar atmosphere).

Example 1

Alloys shown in FIG. 11 were mixed, so as to obtain the compositions of sintered bodies shown in FIGS. 12 and 13. Thereafter, the obtained products were subjected to a hydrogen crushing treatment and then pulverized using a jet mill to a mean particle size of 5.0 μm. The types of the used alloys are also described in FIGS. 12 and 13. Thereafter, the fine powders were compacted in a magnetic field, and then sintered at 1,050° C. or 1,070° C. The obtained sintered bodies were subjected to a two-step aging treatment.

Figure 14:
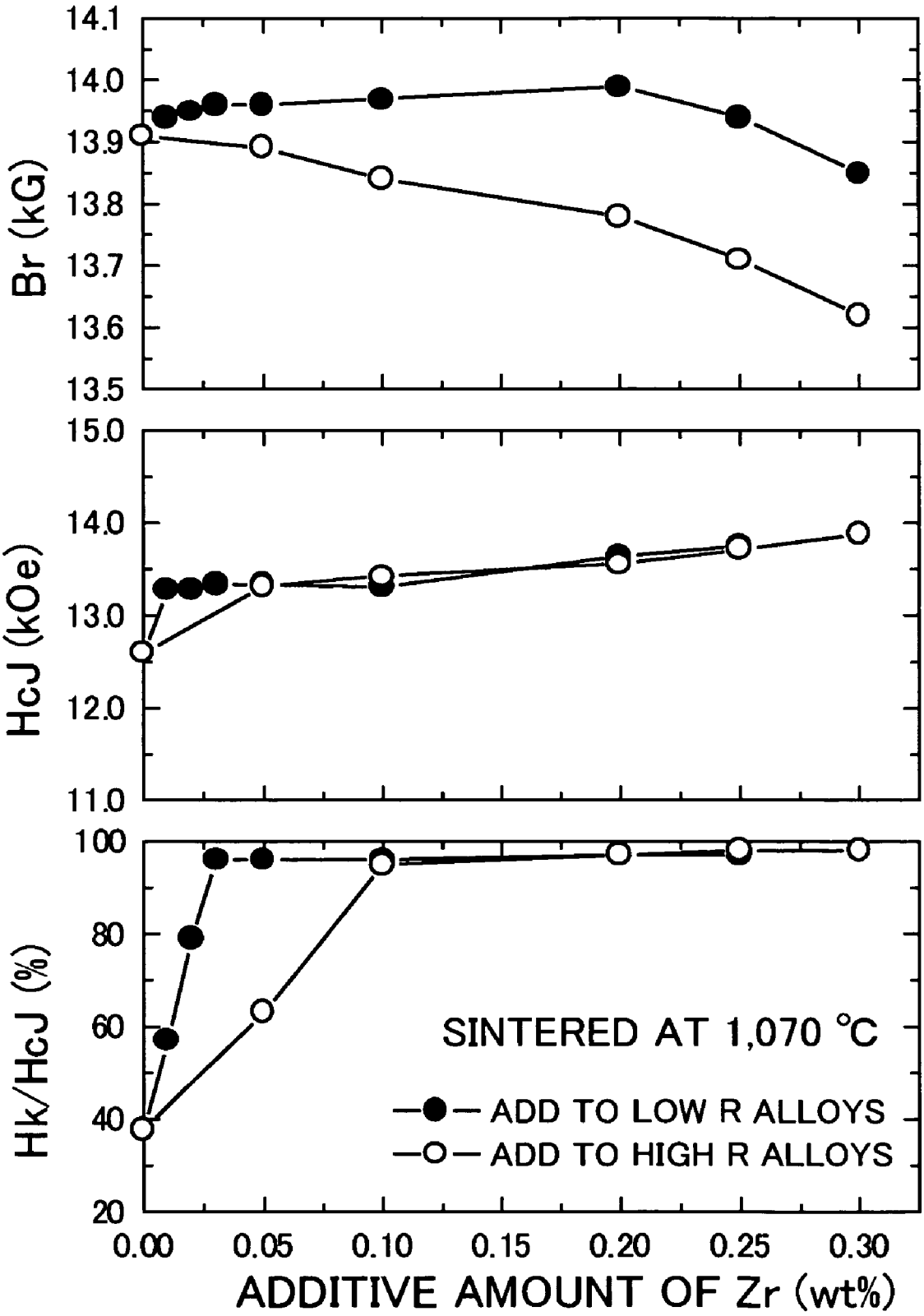
FIG. 14 is a set of graphs showing the relationship between each of the residual magnetic flux density (Br), coercive force (HcJ) and squareness (Hk/HcJ), and the additive amount of Zr in the permanent magnets (sintering temperature: 1,070° C.) obtained in Example 1.
Figure 15:
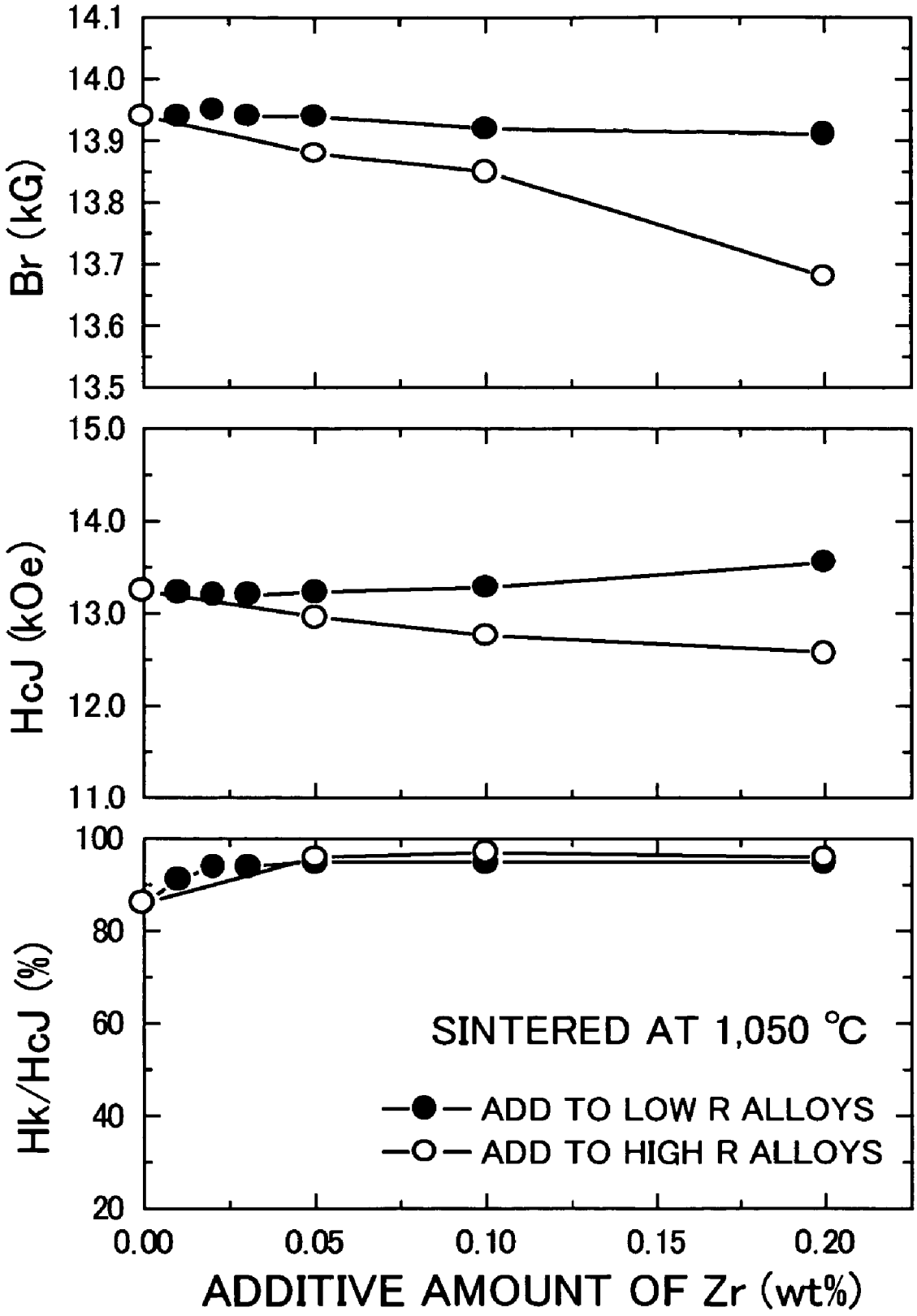
FIG. 15 is a set of graphs showing the relationship between each of the residual magnetic flux density (Br), coercive force (HcJ) and squareness (Hk/HcJ), and the additive amount of Zr in the permanent magnets (sintering temperature: 1,050° C.) obtained in Example 1.

The obtained R-T-B system rare earth permanent magnets were measured with a B-H tracer in terms of their residual magnetic flux density (Br), coercive force (HcJ) and squareness (Hk/HcJ). It should be noted that Hk means an external magnetic field strength obtained when the magnetic flux density becomes 90% of the residual magnetic flux density in the second quadrant of a magnetic hysteresis loop. The results are shown in FIGS. 12 and 13. FIG. 14 is a set of graphs showing the relationship between the additive amount of Zr and magnetic properties at a sintering temperature of 1,070° C., and FIG. 15 is a set of graphs showing the relationship between the additive amount of Zr and magnetic properties at a sintering temperature of 1,050° C. In addition, the results of measurement of the content of oxygen in the sintered bodies are shown in FIGS. 12 and 13. In FIG. 12, the permanent magnets Nos. 1 to 14 contain oxygen within the range between 1,000 and 1,500 ppm. In the same figure, the permanent magnets Nos. 15 to 20 contain oxygen within the range between 1,500 and 2,000 ppm. In FIG. 13, all of the permanent magnets Nos. 21 to 35 contain oxygen within the range between 1,000 and 1,500 ppm.

In FIG. 12, the permanent magnet No. 1 does not contain Zr. The permanent magnets Nos. 2 to 9 contain Zr, which is added to low R alloys thereof. The permanent magnets Nos. 10 to 14 contain Zr, which is added to high R alloys thereof. In the graphs shown in FIG. 14, permanent magnets containing Zr added to low R alloys thereof are described as "add to low R alloys," and permanent magnets containing Zr added to high R alloys thereof are described as "add to high R alloys." It is noted that FIG. 14 refers to permanent magnets containing such a small amount of oxygen as 1,000 to 1,500 ppm as shown in FIG. 12.

From FIGS. 12 and 14, it can be seen that the permanent magnet No. 1 that contains no Zr and was sintered at 1,070° C. had a low level of coercive force (HcJ) and squareness (Hk/HcJ). The microstructure of this permanent magnet was observed, and it was confirmed that coarse crystal grains were generated as a result of the abnormal grain growth.

Figure 16:
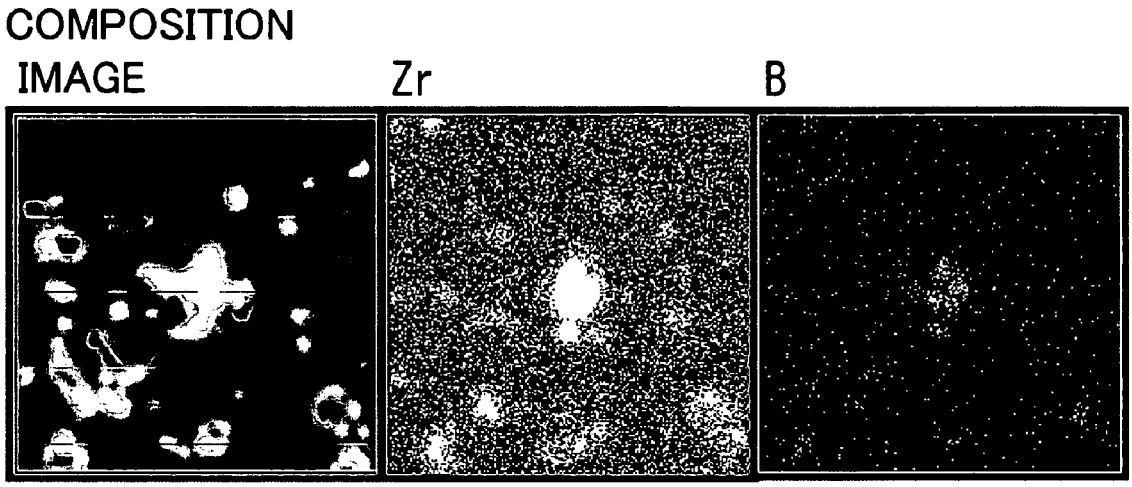
FIG. 16 is a photograph showing the EPMA (Electron Probe Micro Analyzer) element mapping results of the permanent magnets (with the addition of Zr to the high R alloys) in Example 1.

In order that a permanent magnet obtained by addition of Zr to high R alloys thereof has 95% or more squareness (Hk/HcJ), 0.1% Zr needs to be added thereto. In permanent magnets obtained by adding Zr in an amount smaller than the above, the abnormal grain growth was observed. Moreover, as shown in FIG. 16 for example, element mapping observation was carried out using EPMA (Electron Prove Micro Analyzer), and as a result, B and Zr were observed in the same position. Accordingly, it is assumed that a ZrB compound was formed. When the additive amount of Zr is increased to 0.2%, as shown in FIGS. 12 and 14, the decrease of the residual magnetic flux density (Br) becomes non-negligible.

Figure 17:
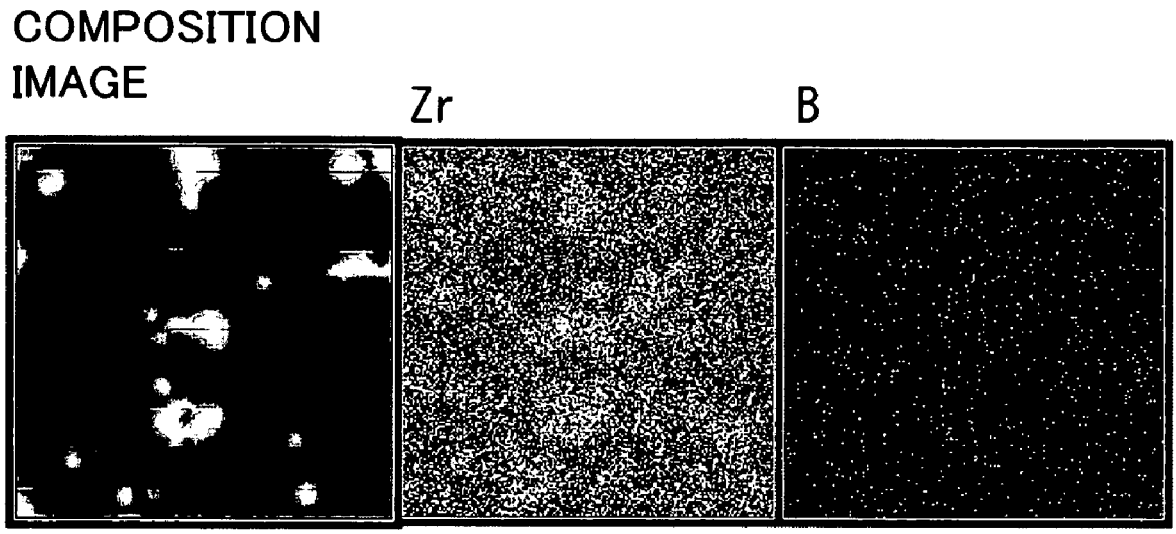
FIG. 17 is a photograph showing the EPMA element mapping results of the permanent magnets (with the addition of Zr to the low R alloys) in Example 1.

In contrast, in the case of adding Zr to low R alloys thereof, the obtained permanent magnet could have 95% or more squareness (Hk/HcJ) by addition of 0.03% Zr. When the microstructure was observed, abnormal grain growth was not found. Moreover, even when more than 0.03% Zr was added, the residual magnetic flux density (Br) and the coercive force (HcJ) did not decrease. Accordingly, when a permanent magnet is manufactured by adding Zr to low R alloys thereof, high magnetic properties can be obtained, even though it is manufactured under conditions such as sintering in a higher temperature range, the reduction of a crushed grain diameter, and a low oxygen atmosphere. However, even in the case of the permanent magnet manufactured by adding Zr to low R alloys thereof, if the additive amount of Zr is increased to 0.3% by weight, the residual magnetic flux density (Br) becomes smaller than that of the permanent magnet containing no Zr. Thus, even in the case of addition to the low R alloys, the additive amount of Zr is preferably 0.25% or less by weight. As in the case of the permanent magnet obtained by addition of Zr to high R alloys thereof, the permanent magnet obtained by addition of Zr to low R alloys thereof was subjected to element mapping observation with EPMA. As a result, as shown in FIG. 17 for example, B and Zr were not observed in the same position.

Focusing attention on the relationship between the amount of oxygen and magnetic properties, it is found from FIGS. 12 and 13 that high magnetic properties can be obtained by reducing the amount of oxygen to 2,000 ppm or less. In FIG. 12, by comparing the permanent magnets Nos. 6 to 8 with the permanent magnet Nos. 16 to 18, and by comparing Nos. 11 and 12 with Nos. 19 and 20, it is found that when the amount of oxygen is reduced to 1,500 ppm or less, the coercive force (HcJ) favorably increases.

From FIGS. 13 and 15, it is found that the permanent magnet No. 21 containing no Zr has a low squareness (Hk/HcJ) of 86%, even when the sintering temperature is 1,050° C. The abnormal grain growth was observed also in the microstructure of this permanent magnet.

In the case of the permanent magnets (Nos. 28 to 30) obtained by addition of Zr to high R alloys thereof, the squareness (Hk/HcJ) is improved by addition of Zr, but as the additive amount of Zr is increased, the residual magnetic flux density (Br) greatly decreases.

In contrast, in the case of the permanent magnets (Nos. 22 to 27) obtained by addition of Zr to low R alloys thereof, the squareness (Hk/HcJ) is improved, and at the same time, the residual magnetic flux density (Br) hardly decreases.

In the permanent magnets Nos. 31 to 35 in FIG. 13, the amount of Al is changed. Considering the magnetic properties of these permanent magnets, it is found that the coercive force (HcJ) is improved by increasing the amount of Al.

The value of Br+0.1×HcJ is described in FIGS. 12 and 13. It is found that the value of each of the permanent magnets obtained by adding Zr to low R alloys thereof is 15.2 or greater, regardless of the additive amount of Zr.

Figure 18:
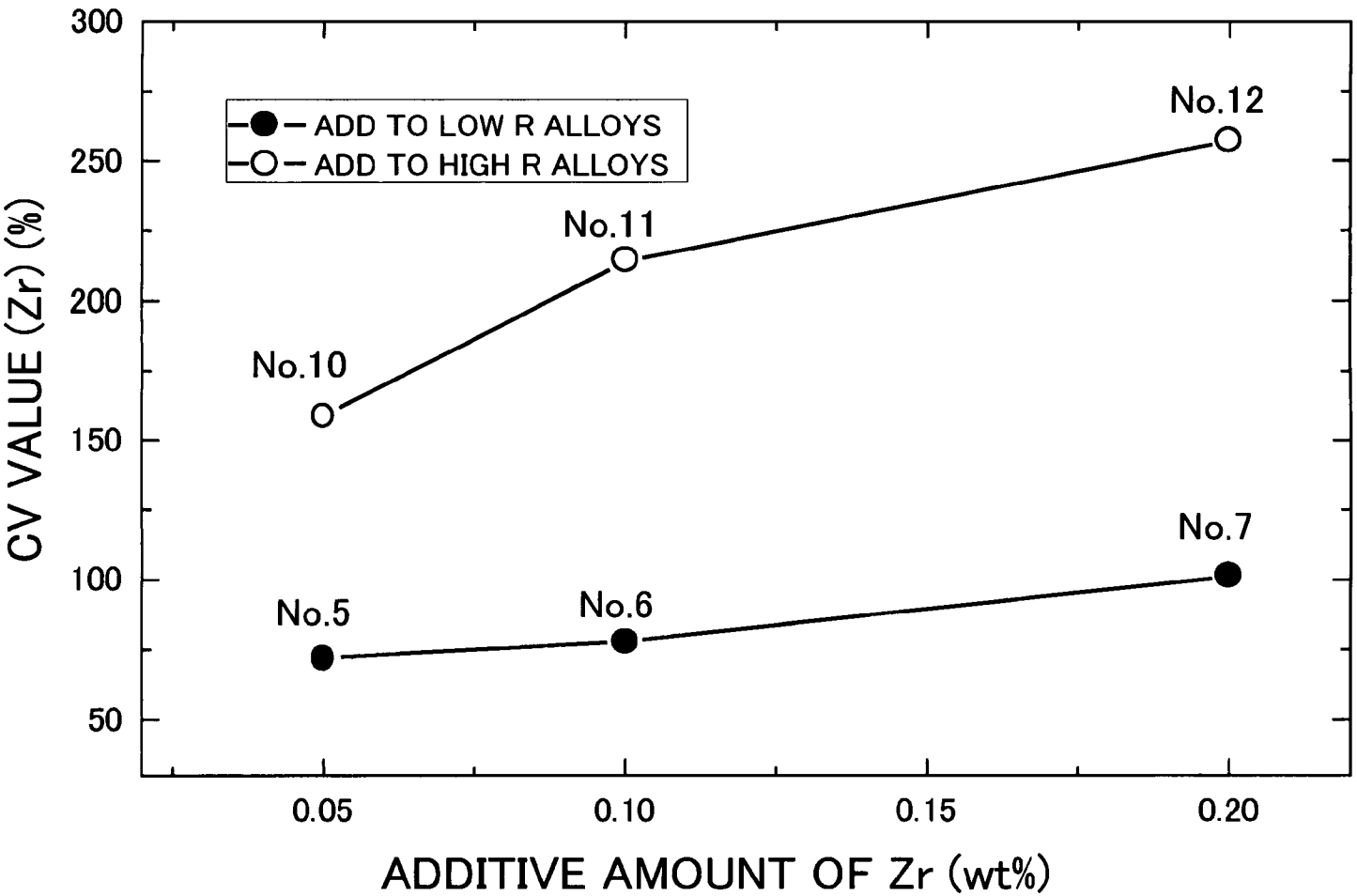
FIG. 18 is a graph showing the relationship between the method of adding Zr to permanent magnets obtained in Example 1 and the additive amount of Zr, and the CV (coefficient of variation) value of Zr.

From the results of the element mapping with EPMA of the permanent magnets Nos. 5, 6, 7, 10, 11 and 12 shown in FIG. 12, the dispersion of Zr was evaluated with a CV (coefficient of variation) value from the result of EPMA analysis. The CV value is a value (percentage) obtained by dividing the standard deviation of all analyzed points by the arithmetic mean value of all analyzed points. As this value is small, it shows that Zr has an excellent dispersion. Moreover, JCMA 733 (wherein PET (pentaerythritol) is used as an analyzing crystal) manufactured by Japan Electron Optics Laboratory Co., Ltd. was used as EPMA, and measurement conditions were determined as mentioned below. The results are shown in FIG. 18. From FIG. 18, it is found that the dispersion of Zr in the permanent magnets (Nos. 5, 6 and 7) obtained by addition of Zr to low R alloys thereof is more excellent than that of the permanent magnets (Nos. 10, 11 and 12) obtained by addition of Zr to high R alloys thereof. In this connection, the CV value of Zr in each permanent magnet is as follows:

No. 5=72, No. 6=78, No. 7=101, No. 10=159, No. 11=214 and No. 12=257

Thus, the good dispersion of Zr, which can be obtained by adding it to a low R alloy is considered to inhibit the abnormal grain growth only with the addition of a small amount of Zr.

Acceleration voltage: 20 kV

Applied electric current: $1\times10^{-7}$ A

Applied time: 150 m sec/point

Measuring point: X→200 points (0.15 μm step)
Y→200 points (0.146 μm step)

Scope: 30.0 μm×30.0 μm

Magnification: 2,000 times

Example 2

Alloys a1, a2, a3 and b1 shown in FIG. 11 were mixed, so as to obtain the compositions of sintered bodies shown in FIG. 19. Thereafter, the obtained products were subjected to a hydrogen crushing treatment and then pulverized using a jet mill to a mean particle size of 4.0 μm. Thereafter, the fine powders were compacted in a magnetic field, and then sintered at 1,010° C. to 1,100° C. The obtained sintered bodies were subjected to a two-step aging treatment.

Figure 20:
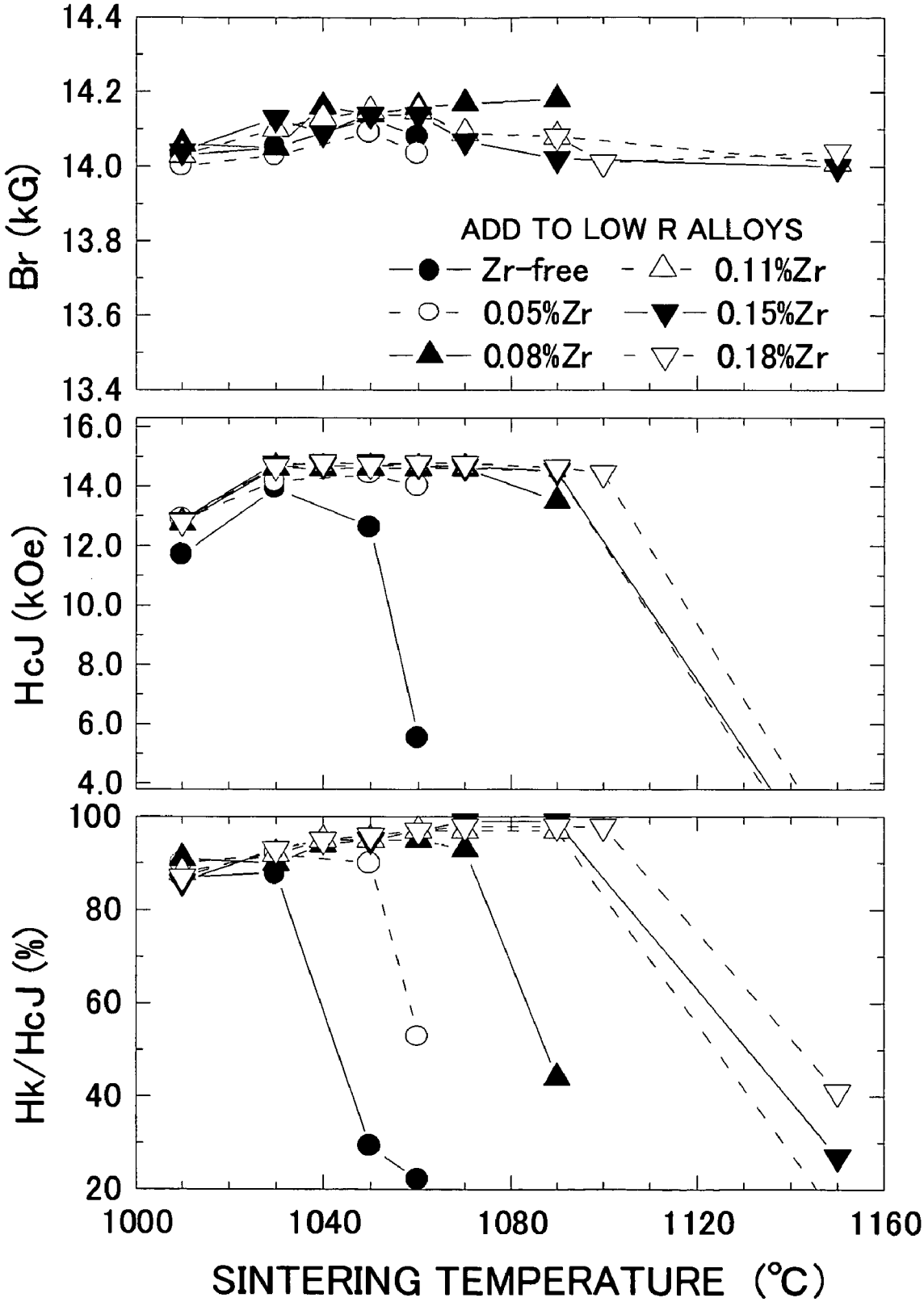
FIG. 20 is a set of graphs showing the relationship between each of the residual magnetic flux density (Br), coercive force (HcJ) and squareness (Hk/HcJ) of permanent magnets obtained in Example 2, and the additive amount of Zr.

The obtained R-T-B system rare earth permanent magnets were measured with a B-H tracer in terms of residual magnetic flux density (Br), coercive force (HcJ) and squareness (Hk/HcJ) In addition, the value Br+0.1×HcJ was also obtained, and the results are also shown in FIG. 19. Moreover, FIG. 20 is a set of graphs showing the relationship between each of the above magnetic properties and the sintering temperature.

In Example 2, in order to obtain higher magnetic properties, the content of oxygen in the sintered body was reduced to 600 to 900 ppm and the mean particle size of the pulverized powders was reduced to 4.0 μm by an oxygen free process. Thus, abnormal grain growth was likely to occur in a sintering process. Accordingly, other than the case of sintering at 1,030° C., the permanent magnets containing no Zr (Nos. 36 to 39 in FIG. 19, which are expressed as "Zr-free" in FIG. 20) had extremely low magnetic properties. Even in the case of sintering at 1,030° C., the squareness was 88%, and it did not reach 90%.

Among magnetic properties, the squareness (Hk/HcJ) tends to decrease most rapidly with the abnormal grain growth. This is to say, the squareness (Hk/HcJ) can be an indicator to grasp the inclination for the abnormal grain growth. Thus, when a zone of sintering temperatures in which 90% or more squareness (Hk/HcJ) could be obtained is defined as a "suitable sintering temperature range", permanent magnets containing no Zr have a suitable sintering temperature range of 0.

In contrast, permanent magnets obtained by addition of Zr to low R alloys thereof have a considerably wide suitable sintering temperature range. In the case of permanent magnets containing 0.05% Zr (FIG. 19, Nos. 40 to 43), 90% or more squareness (Hk/HcJ) can be obtained at the temperature range between 1,010° C. and 1,050° C. In other words, the suitable sintering temperature range of the permanent magnets containing 0.05% Zr is 40° C. Similarly, the suitable sintering temperature range of permanent magnets containing 0.08% Zr (FIG. 19, Nos. 44 to 50), permanent magnets containing 0.11% Zr (FIG. 19, Nos. 51 to 58) and permanent magnets containing 0.15% Zr (FIG. 19, Nos. 59 to 66) is 60° C. The suitable sintering temperature range of permanent magnets containing 0.18% Zr (FIG. 19, Nos. 67 to 75) is 70° C.

FIGS. 21(*a*) to (*d*) are a set of photographs obtained by observing, by SEM (scanning electron microscope), the microstructure in the section of each of permanent magnets No. 37 (sintered at 1,030° C., containing no Zr), No. 39 (sintered at 1,060° C., containing no Zr), No. 43 (sintered at 1,060° C., containing 0.05% Zr) and No. 48 (sintered at 1,060° C., containing 0.08% Zr), all shown in FIG. 19. In addition, FIG. 22 shows the 4 πI-H curve of each of the permanent magnets obtained in Example 2.

As in the case of No. 37, if no Zr is added, the abnormal grain growth is likely to occur, and as shown in FIG. 21(*a*), somewhat rough grains are observed. As in the case of No. 39, if the sintering temperature is such high as 1,060° C., the abnormal grain growth is remarkably observed. As shown in FIG. 21(*b*), coarse crystal grains having a grain diameter of 100 μm or greater are remarkably deposited. In the case of No. 43 to which 0.05% of Zr was added, as shown in FIG. 21(*c*), the number of generated coarse crystal grains can be reduced. In the case of No. 48 to which 0.08% of Zr was added, as shown in FIG. 21(*d*), even though it was sintered at 1,060° C., a fine and uniform microstructure could be obtained, and no coarse crystal grains caused by abnormal grain growth was observed. In the microstructure, no coarse crystal grains with a grain diameter of 100 μm or greater were observed.

Figure 22:
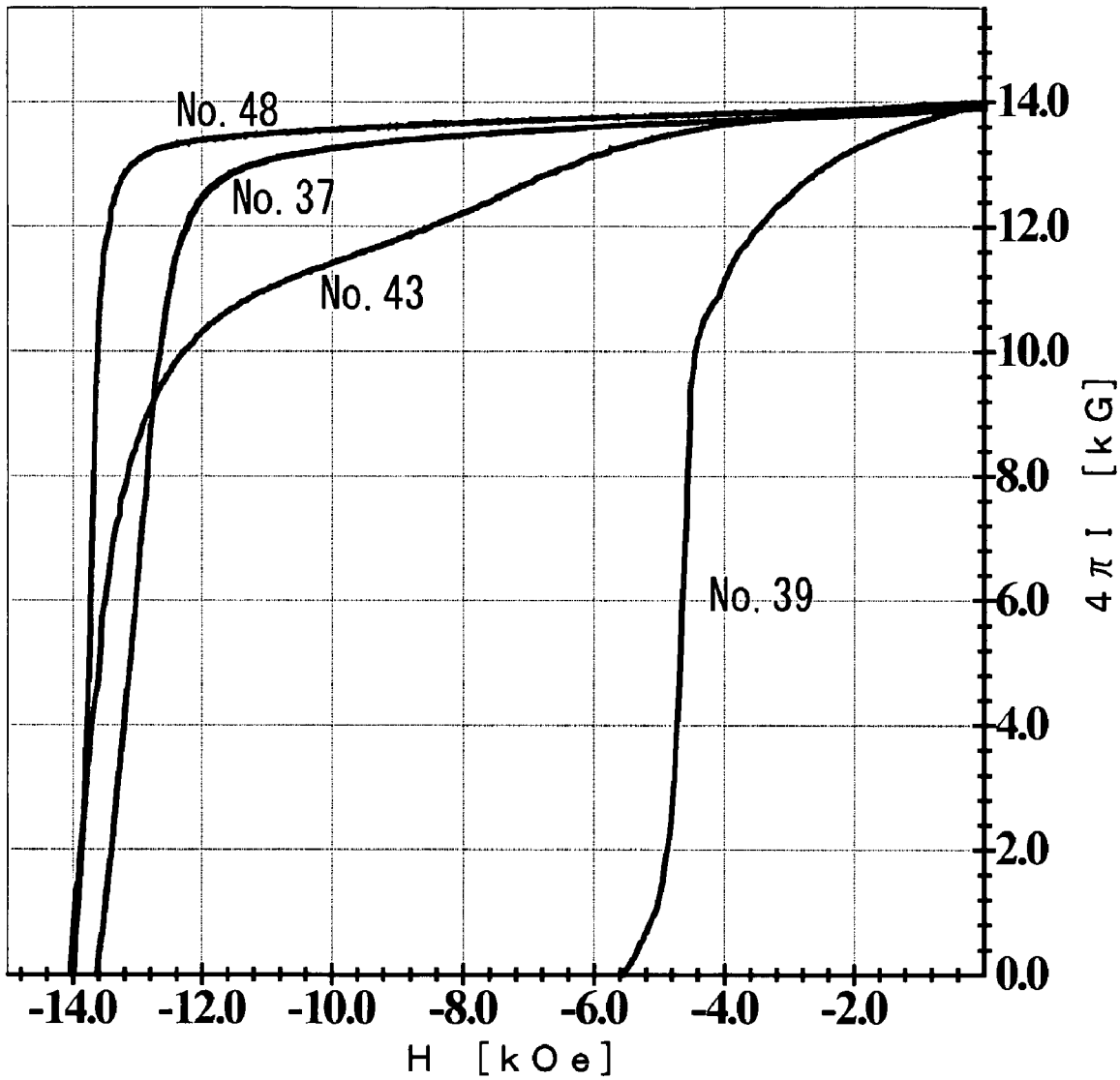
FIG. 22 is a graph showing the 4 πI-H curve of each of the permanent magnets Nos. 37, 39, 43 and 48 obtained in Example 2.

Referring to FIG. 22, in contrast to No. 48 with a fine and uniform microstructure, if coarse crystal grains with a grain diameter of 100 μm or greater are generated as in the case of No. 43, the squareness (Hk/HcJ) decreases first. The decreases in the residual magnetic flux density (Br) and the coercive force (HcJ) are not found at this stage. As shown in No. 39, as the abnormal grain growth progresses and thereby coarse crystal grains with a grain diameter of 100 μm or greater increase, the squareness (Hk/HcJ) significantly deteriorates, and the coercive force (HcJ) decreases. However, the decrease of the residual magnetic flux density (Br) does not start yet.

Subsequently, the permanent magnets Nos. 38 and 54 sintered at 1,050° C. as shown in FIG. 19 were observed by TEM (Transmission Electron Microscope). As a result, the above described product was not found in the permanent magnet No. 38, but it was found in the permanent magnet No. 54. The size of this product was measured. As a result, its major axis was 280 nm, its minor axis was 13 nm, and the axis ratio (major axis/minor axis) was 18.8. Thus, the axis ratio (major axis/minor axis) exceeded 10, and it was found that the product had a large axis ratio and had a platy or acicular form. The sample for the observation was obtained by the ion-milling method, and it was observed by JEM-3010 manufactured by Japan Electron Optics Laboratory Co., Ltd.

Figure 23:
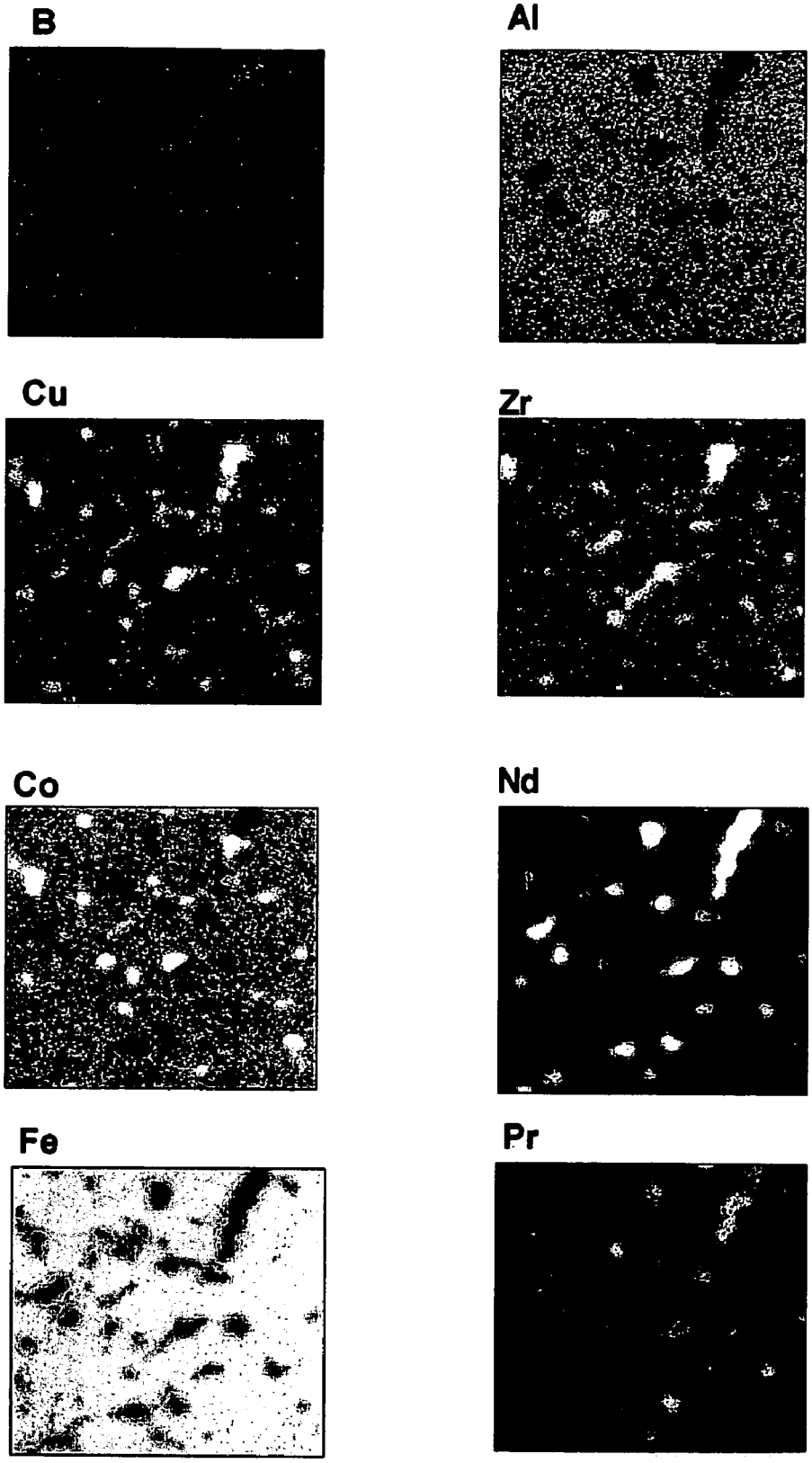
FIG. 23 is a set of photographs showing the mapping image (30 μm×30 μm) of each of elements B, Al, Cu, Zr, Co, Nd, Fe and Pr of the permanent magnet No. 70 obtained in Example 2.
Figure 24:
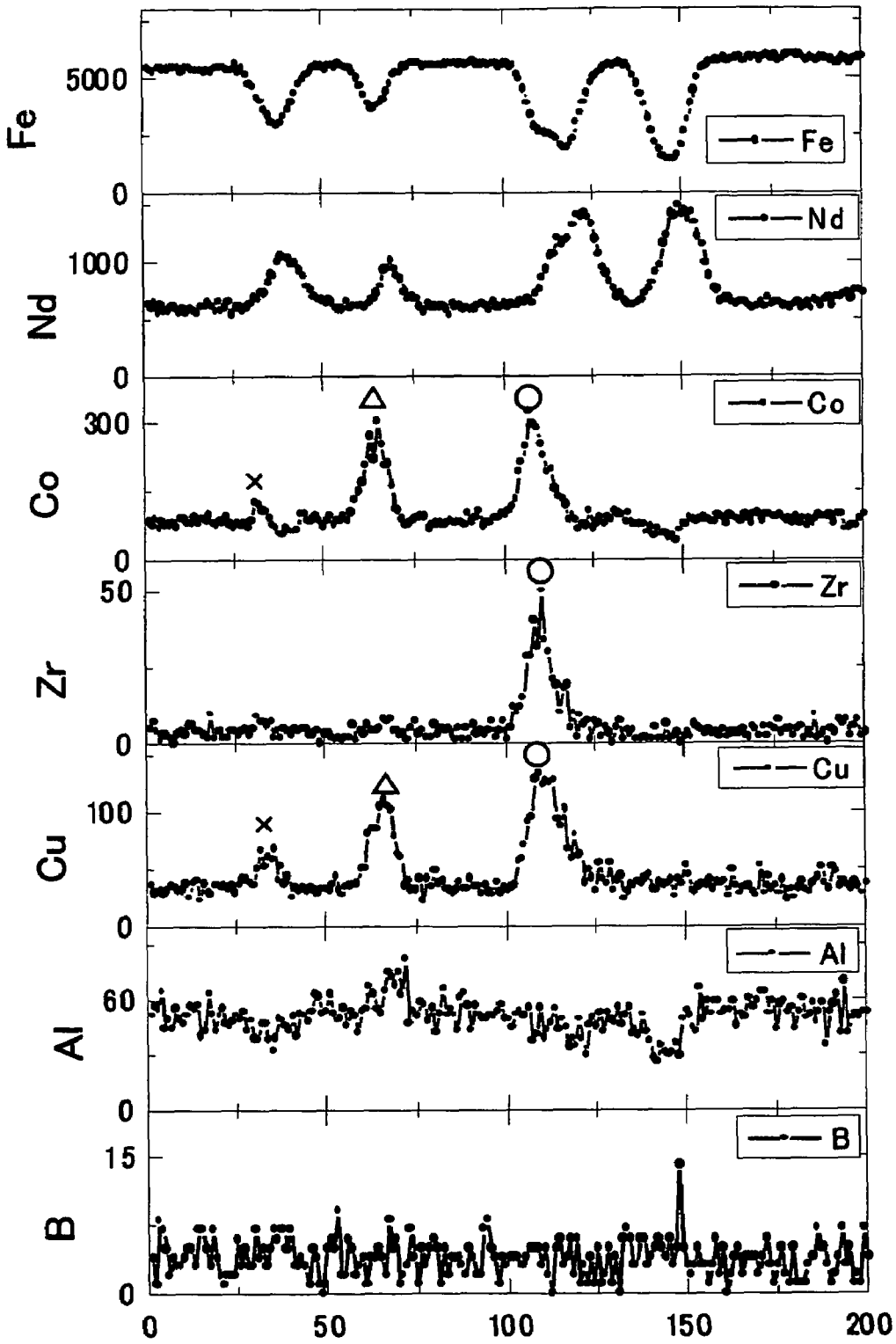
FIG. 24 is one profile of EPMA line analysis of the permanent magnet No. 70 obtained in Example 2.
Figure 25:
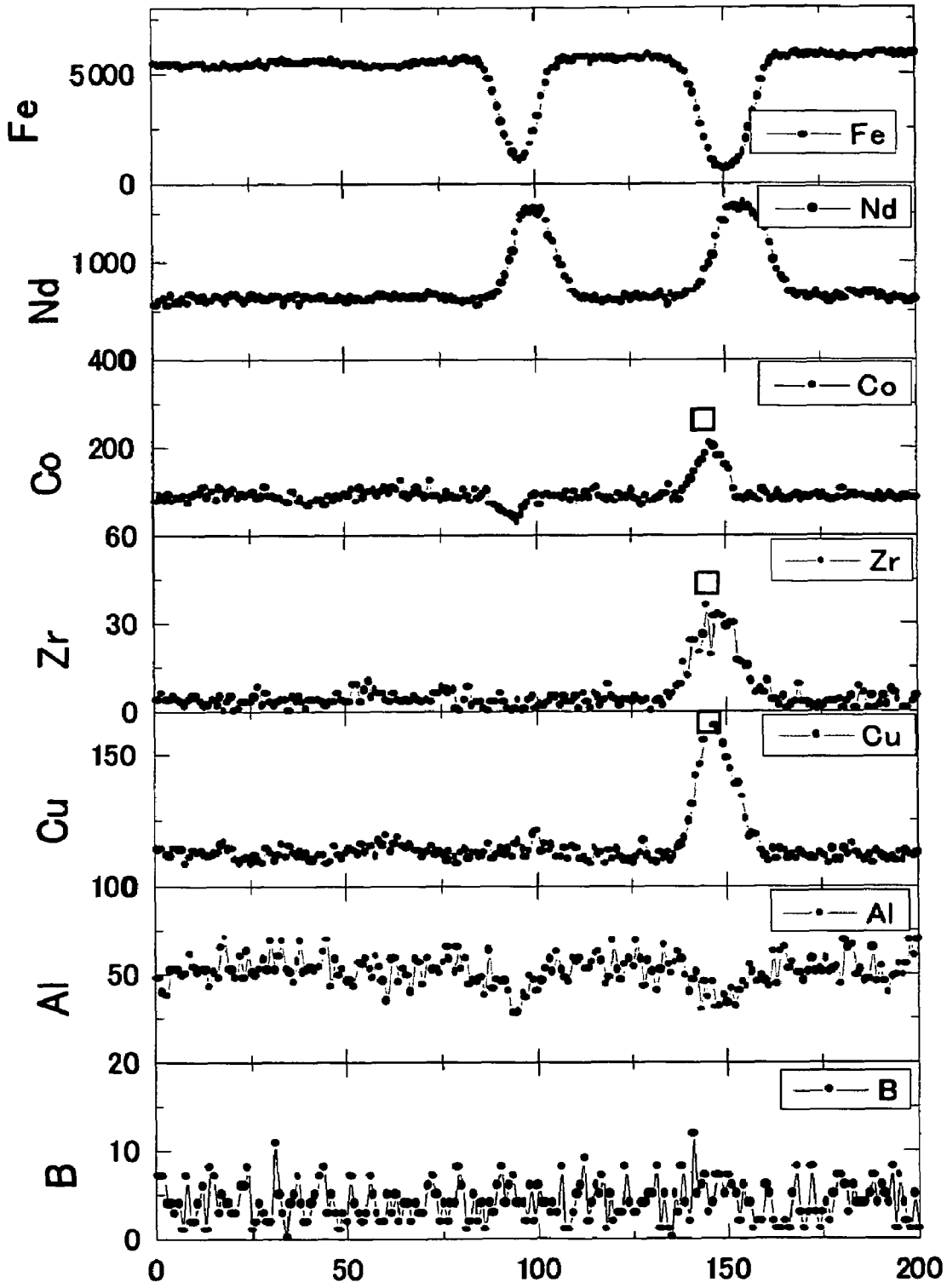
FIG. 25 is the other profile of EPMA line analysis of the permanent magnet No. 70 obtained in Example 2.

Next, the permanent magnet No. 70 shown in FIG. 19 was analyzed by EPMA. FIG. 23 shows the mapping image (30 μm×30 μm) of each of elements B, Al, Cu, Zr, Co, Nd, Fe and Pr of the permanent magnet No. 70. A line analysis was carried out on each of the above elements in the area of the mapping image shown in FIG. 23. The line analysis was carried out based on two different lines. FIG. 24 shows one line analysis profile, and FIG. 25 shows the other line analysis profile.

As shown in FIG. 24, there are positions where the peak positions of Zr, Co and Cu are the same (open circle(○)) and positions where the peak positions of Zr and Cu are the same (triangle (Δ), cross (×)). Moreover, in FIG. 25 also, there are observed the positions where the peak positions of Zr, Co and Cu are the same (rectangular(□)). Thus, a region that is rich in Zr is also rich in Co and/or Cu. Since this Zr rich region overlaps with a region that is rich in Nd but is poor in Fe, it is found that Zr exists in the grain boundary phase in a permanent magnet.

As described above, the permanent magnet No. 70 generates a grain boundary phase that is rich both in one or more types of Co, Cu and Nd, and in Zr. The evidence that Zr and B formed a compound could not be found.

Based on the EPMA analysis, the frequency that the region that is rich in Cu, Co and Nd is identical to the region that is rich in Zr was obtained. As a result, it was found that the region that is rich in Cu is identical to the region that is rich in Zr with a probability of 94%. Likewise, a probability in the case of Co and Zr was 65.3%, and that of the case of Nd and Zr was 59.2%.

Figure 26:
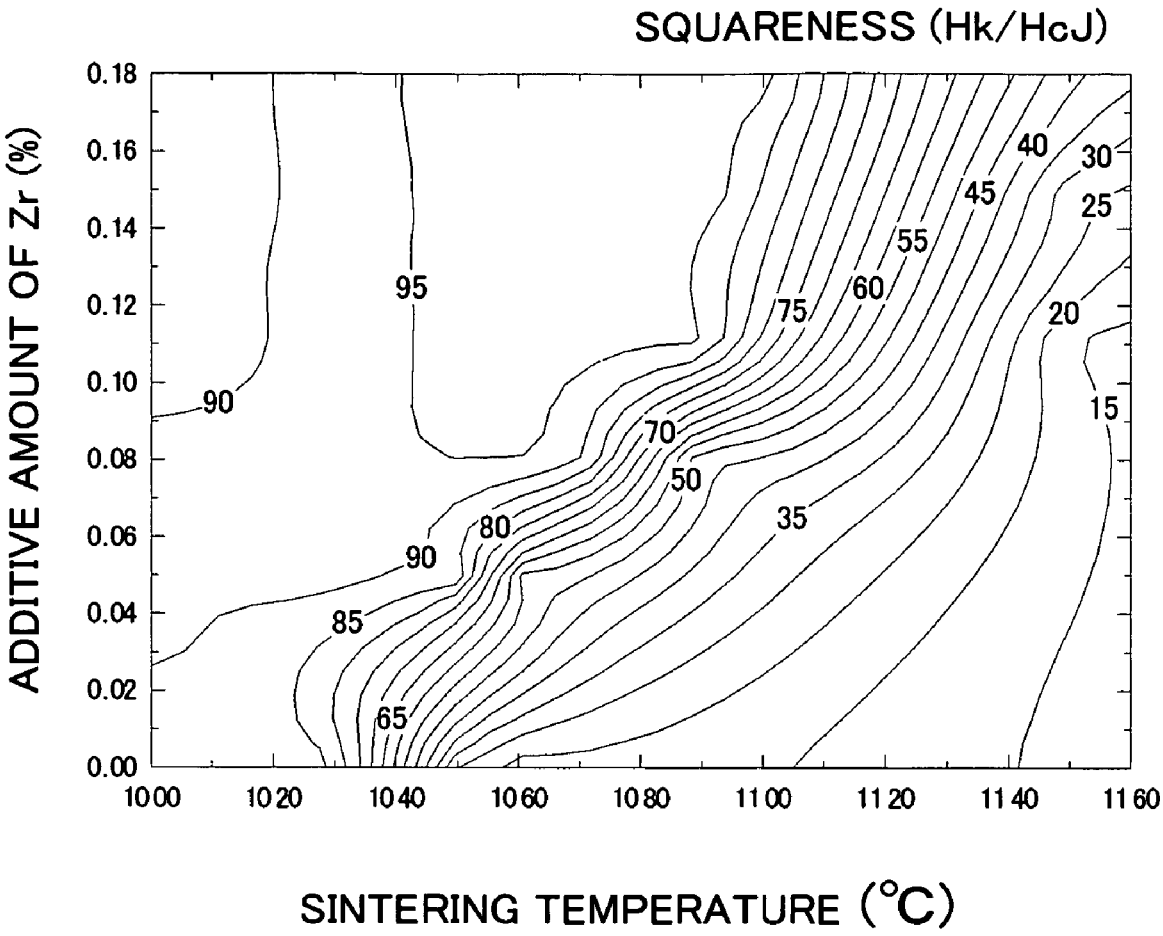
FIG. 26 is a graph showing the relationship among the additive amount of Zr, the sintering temperature, and squareness (Hk/HcJ), in the permanent magnets obtained in Example 2.

FIG. 26 is a graph showing the relationship among the additive amount of Zr, the sintering temperature, and the squareness (Hk/HcJ) in Example 2.

From FIG. 26, it is found that 0.03% or more Zr needs to be added in order to extend the suitable sintering temperature range and to obtain 90% or more squareness (Hk/HcJ) It is also found that 0.08% or more Zr needs to be added in order to obtain 95% or more squareness (Hk/HcJ).

Example 3

R-T-B system rare earth permanent magnets were obtained by the same process as in Example 2, with the exception that alloys a1 to a4 and b1 shown in FIG. 11 were mixed to obtain the compositions of magnets shown in FIG. 27. These permanent magnets contain 1,000 ppm or less oxygen. When the microstructure of sintered bodies was observed, no coarse crystal grains with a grain diameter of 100 μm or greater were found. The residual magnetic flux density (Br), coercive force (HcJ) and squareness (Hk/HcJ) of these permanent magnets were measured with a B-H tracer in the same manner as in Example 1. In addition, the value Br+0.1×HcJ was also obtained. The results are shown in FIG. 27.

One purpose for carrying out Example 3 was confirmation of the change of magnetic properties depending on the amount of Dy. From FIG. 27, it is found that the coercive force (HcJ) increases as the amount of Dy increases. At the same time, all the permanent magnets have a Br+0.1×HcJ value of 15.4 or greater. This shows that the permanent magnet of the present invention can achieve a high level of residual magnetic flux density (Br), while maintaining a certain coercive force (HcJ)

Example 4

Example 4 relates to an experiment to observe products in R-T-B system rare earth permanent magnets obtained by two different manufacturing methods. The two different manufacturing methods include a method of adding Zr to the low R alloys (type A) and a method of adding Zr to the high R alloys (type B). It is noted that the methods for manufacturing an R-T-B system rare earth permanent magnet include a method of using as a starting alloy a single alloy having a desired composition (hereinafter referred to as a single method), and a method of using as starting alloys a plurality of alloys having different compositions (hereinafter referred to as a mixing method). In the mixing method, alloys containing an $R_2T_4B$ phase as a main constituent (low R alloys) and alloys containing a higher amount of R than the low R alloys (high R alloys) are typically used as starting alloys. The permanent magnets described in Example 4 were both manufactured by the mixing method.

Mother alloys (low R alloys and high R alloys) with compositions of sintered bodies shown in FIG. 28 were manufactured by the strip casting method. It is noted that type A contained Zr in its low R alloys, and type B contained Zr in its high R alloys that did not contain B.

Subsequently, a hydrogen crushing process and a mixing and crushing step were carried out under the same conditions as described above. In the mixing and crushing step, 0.05% zinc stearate was added before carrying out pulverizing, and the low R alloys was then mixed with the high R alloys in such combinations as in types A and B as shown in FIG. 28, using a Nauta Mixer for 30 minutes. The mixing ratio between the low R alloys and the high R alloys was 90:10 in both types A and B.

Thereafter, the mixture was subjected to pulverizing with a jet mill to a mean particle size of 5.0 μm. The obtained fine powders were compacted by applying a pressure of 1.2 t/cm$^2$ in a magnetic field with an orientation of 14.0 kOe, so as to obtain a compacted body. A sintering process (sintering temperature: 1,050° C.) and an aging process were carried out on the compacted body under the same conditions as described above, so as to obtain a permanent magnet. The chemical compositions of each of the obtained permanent magnets are described in the column of the composition of sintered body as shown in FIG. 28. FIG. 29 shows the amount of oxygen and the amount of nitrogen of each permanent magnet. As shown in the figure, both the values are as such as the amount of oxygen of 1,000 ppm or lower and the amount of nitrogen of 500 ppm or lower.

Moreover, the sizes of the above products in the R-T-B system rare earth permanent magnets sintered at 1,050° C. were measured. The mean values of the major axis, minor axis and axis ratio of each permanent magnet are shown in FIG. 29. The sample for the observation was prepared by the same method as in Example 2.

As shown in FIG. 29, the axis ratio (major axis/minor axis) of each of types A and B exceeded 10, and thus, it was found that the product had a large axis ratio and had a platy or acicular form. However, although both types A and B are almost the same in their minor axis, the product of type A has a longer major axis, in many cases. Accordingly, type A has a larger axis ratio. More specifically, type A obtained by adding Zr to the low R alloys has a major axis (mean value) of longer than 300 nm and further has a high axis ratio of greater than 20.

The results obtained by comparing the product of type A with the product of type B are shown below.

Figure 30:
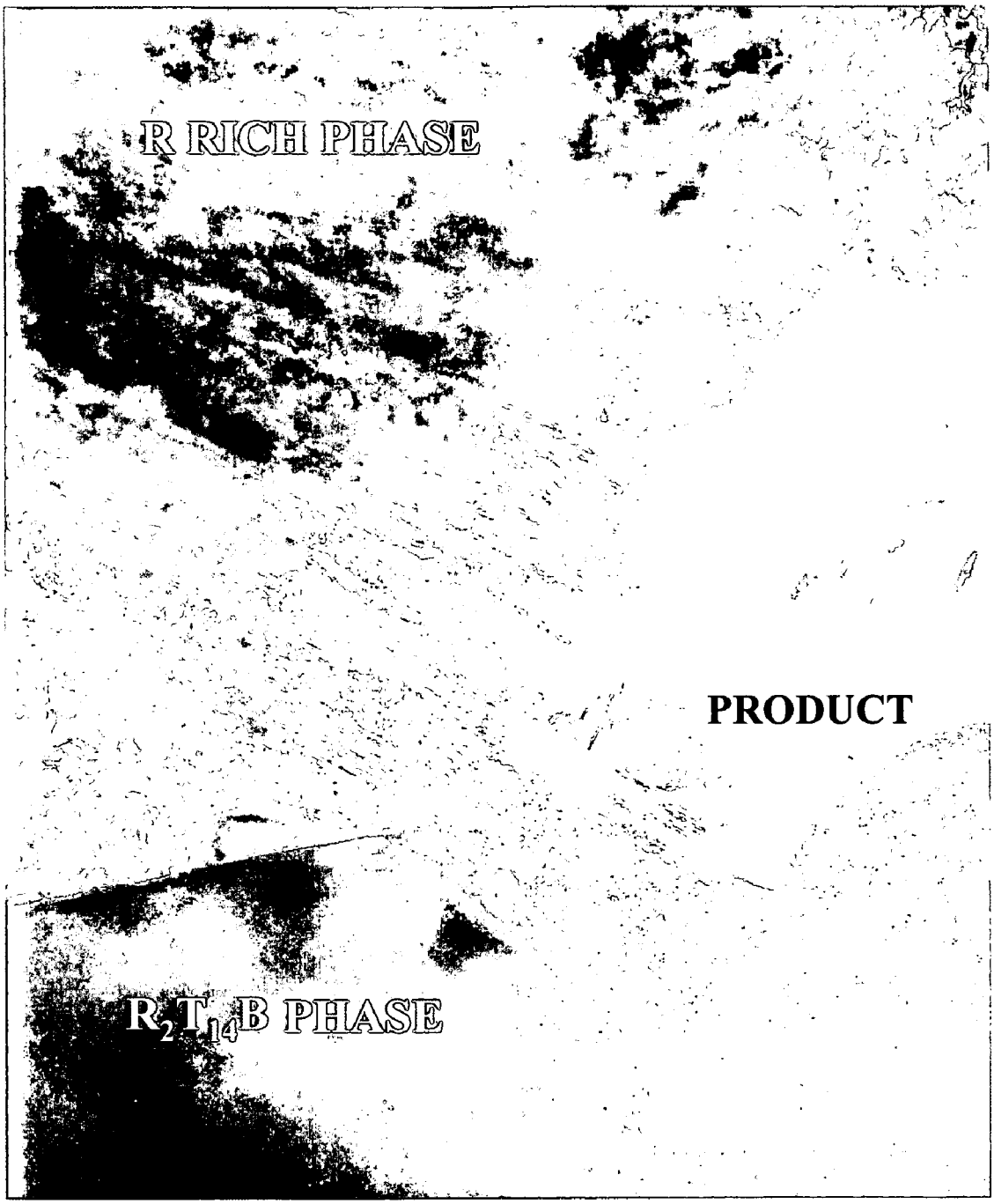
FIG. 30 is a TEM photograph of the permanent magnet (type B) obtained in Example 4.

First, with regard to the compositions of the products, there are no considerable differences between both the products. Then, when the existing states of both the products are observed, the product of type A is often present along the surface of the $R_2T_{14}B$ phase as shown in FIGS. 3 and 4, or is often present, penetrating the two-grain interface as shown in FIG. 5. In contrast, the product of type B is often present, digging into the surface of the $R_2T_{14}B$ phase as shown in FIG. 30.

Now, the reason why the above difference is found between types A and B will be considered in the light of the formation process of the products.

Figure 31:
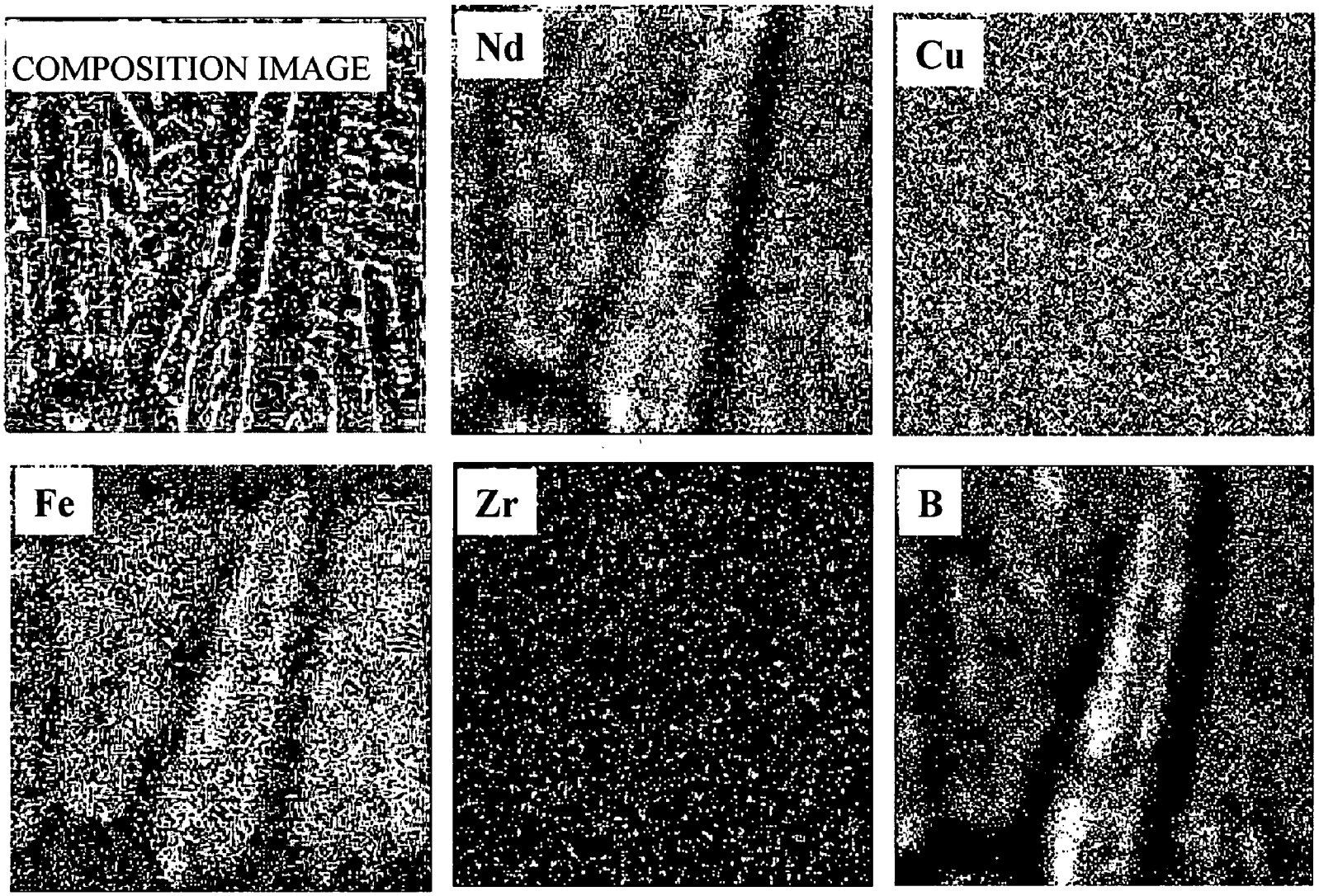
FIG. 31 is a set of photographs showing the EPMA mapping (area analysis) results of a Zr-added low R alloy used for the permanent magnet (type A) in Example 4.
Figure 32:
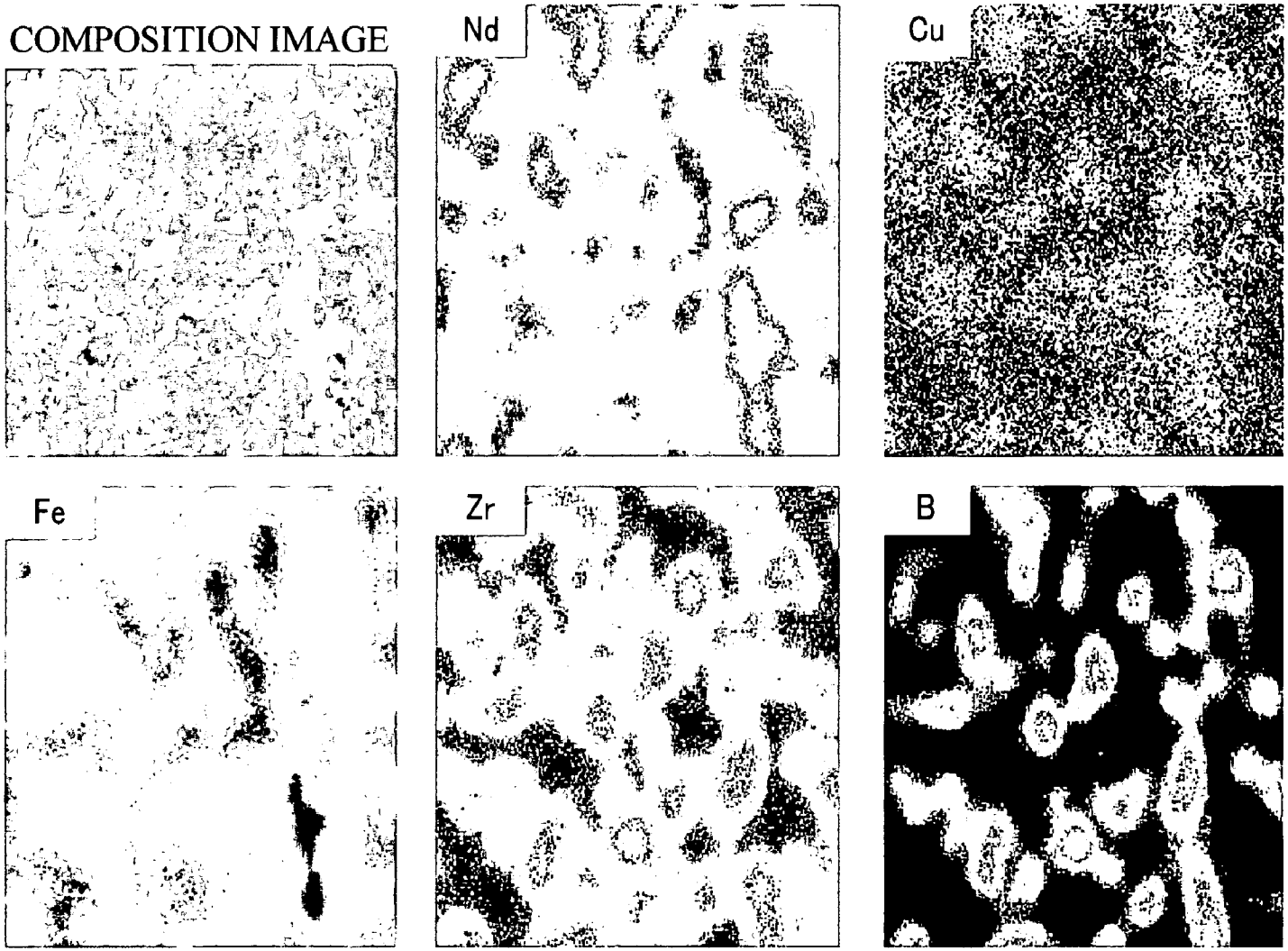
FIG. 32 is a set of photographs showing the EPMA mapping (area analysis) results of a Zr-added high R alloy used for the permanent magnet (type B) in Example 4.

FIG. 31 shows the results of the element mapping (area analysis) on a Zr-added low R alloy used for type A by EPMA (Electron Probe Micro Analyzer). FIG. 32 shows the results of the element mapping (area analysis) on a Zr-added high R alloy used for type B by EPMA (Electron Probe Micro Analyzer). As shown in FIG. 31, the Zr-added low R alloy used for type A comprises at least two phases each having a different amount of Nd. However, in its low R alloy, Zr is uniformly dispersed, and it is not concentrated in a certain phase.

In contrast, in the Zr-added high R alloy used for type B, as shown in FIG. 32, both Zr and B are present in concentrated amounts, in a portion with a high concentration of Nd.

Hence, Zr existing in type A is considerably uniformly distributed in a mother alloy, it is concentrated in a grain boundary phase (liquid phase) during the sintering process, and it then becomes a product, which extends to the easy-crystal grain growth direction because the crystal grows following a nucleation. By this, it is considered that Zr in type A has an extremely large axis ratio. On the other hand, in the case of type B, since a Zr rich phase is formed in the mother alloy stage, the Zr concentration in a liquid phase is hardly increased in the sintering process. Thereafter, since the product is grown based on the existing Zr rich phase as a nucleus, it cannot grow freely. Thus, it is assumed that Zr in type B does not have a large axis ratio.

Accordingly, in order that the present product functions more effectively, the following points would be important:

(1) in the stage of an alloy, Zr is present in an $R_2T_{14}B$ phase, R rich phase or the like, in the form of a solid solution, or it is finely deposited in the phases, (2) a product is generated from a liquid phase during the sintering process, and (3) the growth of the product progresses without the prevention of its growth (achievement of a high axis ratio).

An analysis was carried out on the permanent magnet of type A by EPMA. As a result, the same line analysis profile as shown in FIG. 24 was obtained. In other words, as shown in FIG. 24, there were observed positions where the peak positions of Zr, Co and Cu are coincident (open circle ((○)) and positions where the peak positions of Zr and Cu are coincident (triangle (Δ), cross (×))

Example 5

R-T-B system rare earth permanent magnets were obtained by the same process as in Example 2, with the exception that alloys a7, a8, b4 and b5 shown in FIG. 11 were mixed to obtain the compositions of sintered bodies shown in FIG. 33. The permanent magnet No. 80 in FIG. 33 was obtained by mixing the alloy a7 with the alloy b4 at a weight ratio of 90:10, and the permanent magnet No. 81 in the same figure was obtained by mixing the alloy a8 with the alloy b5 at a weight ratio of 80:20. The mean particle size of powders was 4.0 μm after pulverizing. As shown in FIG. 33, the amount of oxygen contained in the obtained permanent magnets was 1,000 ppm or less. When the microstructure of sintered bodies was observed, no coarse crystal grains with a grain diameter of 100 μm or greater were found. The residual magnetic flux density (Br), coercive force (HcJ) and squareness (Hk/HcJ) of these permanent magnets were measured with a B-H tracer in the same manner as in Example 1. In addition, the value Br+0.1×HcJ was also obtained. Furthermore, the CV value was obtained. The results are shown in FIG. 33.

As shown in FIG. 33, even when the content of constitutional elements were changed from Examples 1, 2, 3 and 4, a high level of residual magnetic flux density (Br) could be obtained, while maintaining a certain coercive force (HcJ).

INDUSTRIAL APPLICABILITY

As described in detail above, the abnormal grain growth occurring during sintering can be inhibited by the addition of Zr. Thus, even when processes such as the reduction of the amount of oxygen are adopted, the decrease in a squareness can be inhibited. In particular, according to the present invention, since Zr can be present in a sintered body with good dispersion, the amount of Zr used to inhibit the abnormal grain growth can be reduced. Accordingly, the deterioration of other magnetic properties such as a residual magnetic flux density can be kept to a minimum. Moreover, according to the present invention, since a suitable sintering temperature range of 40° C. or more can be kept, even using a large sintering furnace that is usually likely to cause unevenness in heating temperature, an R-T-B system rare earth permanent magnet consistently having high magnetic properties can be easily obtained.

Furthermore, according to the present invention, a product that is rich in Zr and has a large axis ratio can be present in the triple-point grain boundary phase or two-grain grain boundary phase of an R-T-B system rare earth permanent magnet containing Zr. The presence of this product enables to further inhibit the growth of an $R_2T_{14}B$ phase in the sintering process and to improve the suitable sintering temperature range. Therefore, according to the present invention, a heat treatment on a large magnet and a stable manufacturing of an R-T-B system rare earth permanent magnet using such a large heat treatment furnace can be easily carried out.

What is claimed is:

1. An R-T-B system rare earth permanent magnet, comprising a main phase consisting of an $R_2T_{14}B_1$ phase (wherein R represents one or more rare earth elements (provided that the rare earth elements include Y), and T represents at least one transition metal element containing, as a main constituent, Fe, or Fe and Co), and a grain boundary phase containing a higher total amount of R than said main phase, said R-T-B system rare earth permanent magnet being a sintered body having a composition consisting essentially of 28% to 33% by weight of R, 0.5% to 1.5% by weight of B, 0.03% to 0.3% by weight of Al, 0.3% or less (excluding 0) by weight of Cu, 0.05% to 0.2% by weight of Zr, 4% or less by weight (excluding 0) of Co 0.2% or less by weight of oxygen, and the balance substantially being Fe, said sintered body containing a region that is rich both Cu and Zr.

2. An R-T-B system rare earth permanent magnet according to claim 1, wherein said rich region exists in said grain boundary phase.

3. An R-T-B system rare earth permanent magnet according to claim 1 or 2, wherein said rich region is additionally rich in Co, or rich in Co and R, and wherein with regard to the profile of a line analysis by EPMA, the peaks of Cu and Zr are coincident with the peak of Co, or with the peaks of Co and R, in said rich region.

4. An R-T-B system rare earth permanent magnet according to claim 1, wherein the amount of oxygen contained in said sintered body is 2,000 ppm or less.

5. An R-T-B system rare earth permanent magnet according to claim 1, wherein a coefficient of variation (CV value) showing the dispersion degree of Zr in said sintered body is 130 or less.

6. R-T-B system rare earth permanent magnet according to claim 1, which satisfies the condition that, with regard to a residual magnetic flux density (Br) and a coercive force (HcJ), Br+0.1×HcJ (dimensionless) is 15.2 or greater.

* * * * *